US008579419B2

(12) United States Patent
Tojo

(10) Patent No.: US 8,579,419 B2
(45) Date of Patent: Nov. 12, 2013

(54) FLUID EJECTING APPARATUS

(75) Inventor: Seiji Tojo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 429 days.

(21) Appl. No.: 12/616,305

(22) Filed: Nov. 11, 2009

(65) Prior Publication Data

US 2010/0118082 A1 May 13, 2010

(30) Foreign Application Priority Data

| | | |
|---|---|---|
| Nov. 13, 2008 | (JP) | 2008-290890 |
| Feb. 6, 2009 | (JP) | 2009-026622 |
| Jul. 16, 2009 | (JP) | 2009-168186 |
| Jul. 16, 2009 | (JP) | 2009-168187 |

(51) Int. Cl.
*B41J 2/17* (2006.01)

(52) U.S. Cl.
USPC ..... 347/84

(58) Field of Classification Search
None
See application file for complete search history.

(56) References Cited

U.S. PATENT DOCUMENTS

| | | | | |
|---|---|---|---|---|
| 6,886,907 | B1 * | 5/2005 | Okamoto et al. | 347/33 |
| 7,753,476 | B2 * | 7/2010 | Shindo | 347/30 |
| 2007/0085874 | A1 | 4/2007 | Shindo | |

FOREIGN PATENT DOCUMENTS

| | | |
|---|---|---|
| JP | 09-131882 | 5/1997 |
| JP | 2008-023888 | 2/2008 |

* cited by examiner

*Primary Examiner* — Matthew Luu
*Assistant Examiner* — Erica Lin
(74) *Attorney, Agent, or Firm* — Workman Nydegger

(57) ABSTRACT

A fluid ejecting apparatus includes: a carriage that supports a fluid ejecting head for ejecting fluid through a plurality of nozzles and is able to be reciprocated; a cap unit that comes in contact with the fluid ejecting head to form a plurality of cap internal spaces individually enclosing the nozzles; a suction unit that is able to suck the cap internal spaces via respective suction passages; and a selective blocking unit that is able to selectively block the suction passages as the carriage is reciprocated in a maintenance area for the maintenance of the fluid ejecting head, wherein the selective blocking unit includes: a blocking member that is reciprocated as the carriage is reciprocated in the maintenance area; and cam surfaces that engage with the blocking member as the blocking member is reciprocated to lead the blocking member to blocking positions for blocking the suction passages in order.

7 Claims, 19 Drawing Sheets

FLUID EJECTING APPARATUS

BACKGROUND

1. Technical Field

The present invention relates to a fluid ejecting apparatus such as an ink jet printer.

2. Related Art

In general, as a kind of fluid ejecting apparatus for ejecting fluid toward a target from a nozzle provided in a fluid ejecting head, an ink jet printer (hereinafter, simply referred to as "printer") is known. In such a printer, since a nozzle opens to a nozzle formation surface of a print head (fluid ejecting head), as an ink solvent evaporates from the nozzle, ink (fluid) is thickened, which may cause ink ejection failure. Accordingly, such a printer is generally provided with a head maintenance mechanism.

The head maintenance mechanism is configured such that the mechanism includes a cap member which is able to come in contact with the print head to enclose the nozzle and a suction pump (suction unit) provided in an ink discharge passage connected to the cap member, and a negative pressure is generated in the cap member by driving the suction pump to suck and remove the thickened ink from the nozzle. A printer having such a head maintenance mechanism is disclosed in JP-A-9-131882.

The printer in JP-A-9-131882 is provided with a head reliability maintenance and recovery station in a head recovery area (maintenance area) other than in a print area of a moving area of a carriage. In the head reliability maintenance and recovery station, four cap members as cap units which come in contact with the respective four print heads (nozzles) supported by the carriage for sealing them are stored in a sled member supported by a guide frame to move in the same direction as the carriage. On an end portion of the sled member on the opposite side to the print area, a pin member which is engaged with the carriage stands, and the sled member is always biased by a spring toward the print area.

In addition, in the head reliability maintenance and recovery station, when the carriage is moved to the opposite side to the print area, the sled member is moved toward the same direction as the carriage with the pin member interposed therebetween against the biasing force of the spring, and when the carriage is moved toward the print area, the sled member is moved in the same direction as the carriage by the biasing force of the spring.

In addition, on the end portion of the sled member on the opposite side to the print area, a first member having four ink sucking communication holes to which the other ends of four tubes of which the one ends are connected to the respective cap members are connected is mounted. At the position opposed to an upper portion of the first member, a second member having an ink sucking communication hole to which the other end of a tube of which the one end is connected to the sucking pump is connected is fixed. In addition, in a state where the sled member is moved at a position where each cap member comes in contact with the corresponding print head, the second member comes in contact with the upper surface of the first member, and one of the ink sucking communication holes of the first member and the ink sucking communication hole of the second member are connected to each other.

In this case, which one among the ink sucking communication holes of the first member is connected to the ink sucking communication hole of the second member is determined by the position of the carriage which is able to move the first member with the sled member interposed therebetween. That is, among the cap members, the one that is sucked by the suction pump is determined by the position of the carriage. Therefore, in the printer of JP-A-9-131882, the print heads can be selectively sucked by controlling the position of the carriage.

However, in the printer of JP-A-9-131882, the ink sucking communication holes of the first member are arranged along the movement direction of the carriage. Therefore, when the sled member is moved by the carriage such that the ink sucking communication hole closest to the print area among the ink sucking communication holes of the first member is connected to the ink sucking communication hole of the second member, the sled member significantly protrudes to the opposite side to the print area from the guide frame. Therefore, a space where the sled member protrudes needs to be ensured, and this causes a problem of an increase in the size of the printer.

SUMMARY

An advantage of some aspects of the invention is that it provides a fluid ejecting apparatus capable of selectively sucking internal spaces of a plurality of caps without increasing the size.

According to an aspect of the invention, there is provided a fluid ejecting apparatus including: a carriage that supports a fluid ejecting head for ejecting fluid through a plurality of nozzles and is able to be reciprocated; a cap unit that comes in contact with the fluid ejecting head to form a plurality of cap internal spaces individually enclosing the nozzles; a suction unit that is able to suck the cap internal spaces via respective suction passages; and a selective blocking unit that is able to selectively block the suction passages as the carriage is reciprocated in a maintenance area for the maintenance of the fluid ejecting head, wherein the selective blocking unit includes: a blocking member that is reciprocated as the carriage is reciprocated in the maintenance area; and cam surfaces that engage with the blocking member as the blocking member is reciprocated to lead the blocking member to blocking positions for blocking the suction passages in order.

Accordingly, when the blocking member is reciprocated as the carriage is reciprocated in the existing maintenance area, the blocking member is led to the blocking positions for blocking the suction passages in order by the cam surfaces, so that it is possible to selectively block the suction passages without expanding the movement range of the carriage. Therefore, it is possible to selectively suck the plurality of cap internal spaces without an increase in size.

In the fluid ejecting apparatus, each suction passage is formed of a tube having flexibility, and when the blocking member is at the blocking position, the blocking member crushes the tube corresponding to the blocking member.

Accordingly, without a complex switch valve device, it is possible to easily block the suction passages by crushing the tubes using the blocking member.

In the fluid ejecting apparatus, a pressing member that is able to press the tube is disposed at each blocking position, and the blocking member crushes the tube via the pressing member when the blocking member is moved to the blocking position.

Accordingly, it is possible to reliably crush the tubes by the blocking member via the pressing member.

In the fluid ejecting apparatus, the pressing member includes: a first member having a sliding surface on which the blocking member slides as the carriage is reciprocated to allow the pressing member to move in a direction to press the tube; a second member that is disposed between the first member and the tube so as to come in contact with and press the tube; and a compression spring that is maintained between the first member and the second member in a state where it generates a pressing load needed to crush the tube and block the suction passage, and of which a load per unit displacement is set to be smaller than a load per unit displacement needed for the second member to additionally crush the tube after pressing the tube and blocking the suction passage.

Accordingly, the load per unit displacement of the compression spring is set to be smaller than a load per unit displacement needed for the second member to additionally crush the tube after blocking the suction passage. Therefore, the compression spring shrinks after the second member crushes the tube and the suction passage is blocked, so that it is possible to prevent the second member from excessively crushing the tube. As a result, it is possible to reduce loads that occur when the carriage is moved and the blocking member slides.

In the fluid ejecting apparatus, the sliding surface is configured by a plurality of surfaces that are set to allow a degree of movement of the pressing member to differ in a direction to press the tube as the blocking member slides, and the surfaces are arranged such that the degree of movement of the pressing is decreased in the direction to press the tube as the degree of pressing at which the tube is pressed by the pressing member is increased.

Accordingly, the surfaces configuring the sliding surface are arranged such that the movement degree of the pressing is decreased in the direction to press the tube as the pressing degree at which the tube is pressed by the pressing member is increased. Accordingly, it is possible to suppress the pressing member from excessively crushing the tube after the tube is crushed by the pressing member and the suction passage is blocked. As a result, it is possible to reduce loads that occur when the carriage is moved and the blocking member slides.

In the fluid ejecting apparatus, the cap unit includes a cap member that engages with the carriage as the carriage is moved in the maintenance area to move along the movement direction of the carriage so as to be moved in a direction to approach the fluid ejecting head and then come in contact with the fluid ejecting head, and while the carriage is reciprocated in the maintenance area, the contacting state of the cap member with the fluid ejecting head is maintained.

Accordingly, without a driving source for allowing the cap member to come in contact with the fluid ejecting head, it is possible to allow the cap member to come in contact with the fluid ejecting head by the movement of the carriage. In addition, even in the case where the carriage is reciprocated in the maintenance area so as to lead the blocking member to the blocking positions for blocking the suction passage in order, it is possible to maintain the contacting state of the cap member with the fluid ejecting head.

According to another aspect of the invention, there is provided a fluid ejecting apparatus including: a carriage that supports a fluid ejecting head for ejecting fluid through a plurality of nozzles and is able to be reciprocated; a cap unit that comes in contact with the fluid ejecting head to form a plurality of cap internal spaces individually enclosing the nozzles; a suction unit that is able to suck the cap internal spaces via respective suction passages; and a selective blocking unit that is able to selectively block the suction passages as the carriage is reciprocated in a maintenance area for the maintenance of the fluid ejecting head, wherein the selective blocking unit includes: a blocking member that is moved along with the carriage and moves in a direction substantially perpendicular to the movement direction of the carriage and a direction in which the cap unit comes in contact with the fluid ejecting head; cam surfaces that engage with the blocking member as the carriage is reciprocated in the maintenance area and allow the blocking member to move in the direction substantially perpendicular to the movement direction of the carriage and the direction in which the cap unit comes in contact with the fluid ejecting head; and a plurality of selection paths into which the blocking member that is moved in the direction substantially perpendicular to the movement direction of the carriage and the direction in which the cap unit comes in contact with the fluid ejecting head enters, and that are set in advance to select whether or not the blocking member is to block the corresponding suction passage when the blocking member enters.

Accordingly, when the blocking member is reciprocated as the carriage is reciprocated in the existing maintenance area, the blocking member enters into the selection path to select whether or not to select the suction passage, so that it is possible to selectively block the suction passages without expanding the movement range of the carriage. Therefore, it is possible to selectively suck the plurality of cap internal spaces without an increase in size.

In the fluid ejecting apparatus, each suction passage is formed of a tube having flexibility, each selection path includes a selection path in which a pressing member for pressing the tube when the blocking member enters is disposed and a selection path in which the pressing member is not disposed, and the selection path into which the blocking member is to enter is selected from among the selection paths by the reciprocating movement of the carriage in the maintenance area.

Accordingly, in the case where the selection path in which the pressing member is disposed is selected as the selection path into which the blocking member is to enter, the tube is pressed by the pressing member, and in the case where a selection path in which the pressing member is not disposed is selected as the selection path into which the blocking member is to enter, the tube is not pressed by the pressing member.

According to another aspect of the invention, there is provided a fluid ejecting apparatus including; a carriage that supports a fluid ejecting head for ejecting fluid through a plurality of nozzles and is able to be reciprocated; a cap unit that comes in contact with the fluid ejecting head to form a plurality of cap internal spaces individually enclosing the nozzles; a suction unit that is able to suck the cap internal spaces via respective suction passages; an atmosphere opening passage that opens each cap internal space to the atmosphere; and a selective blocking unit that is able to selectively block the atmosphere opening passages as the carriage is reciprocated in a maintenance area for the maintenance of the fluid ejecting head, wherein the selective blocking unit includes: a blocking member that is reciprocated as the carriage is reciprocated in the maintenance area; and cam surfaces that engage with the blocking member as the blocking member is reciprocated and lead the blocking member to the blocking positions for blocking the atmosphere opening passages in order.

Accordingly, when the blocking member is reciprocated as the carriage is reciprocated in the existing maintenance area, the blocking member is led to the blocking positions for blocking the atmosphere opening passages by the cam surfaces in order, so that it is possible to selectively block the atmosphere opening passages without expanding the movement range of the carriage. That is, by selectively blocking the atmosphere opening passages, it is possible to selectively block the cap internal spaces corresponding to the blocked atmosphere opening passage. Therefore, it is possible to selectively suck the plurality of cap internal spaces without an increase in size.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an ink jet printer according to an embodiment of the invention will be described with reference to the accompanying drawings. In addition, in the following description, in the case where a "front and rear direction", an "up and down direction", and a "left and right direction" are described, unless otherwise defined, they are matched with the "front and rear direction", the "up and down direction", and the "left and right direction" of FIG. 1 as a reference.

Figure 1:
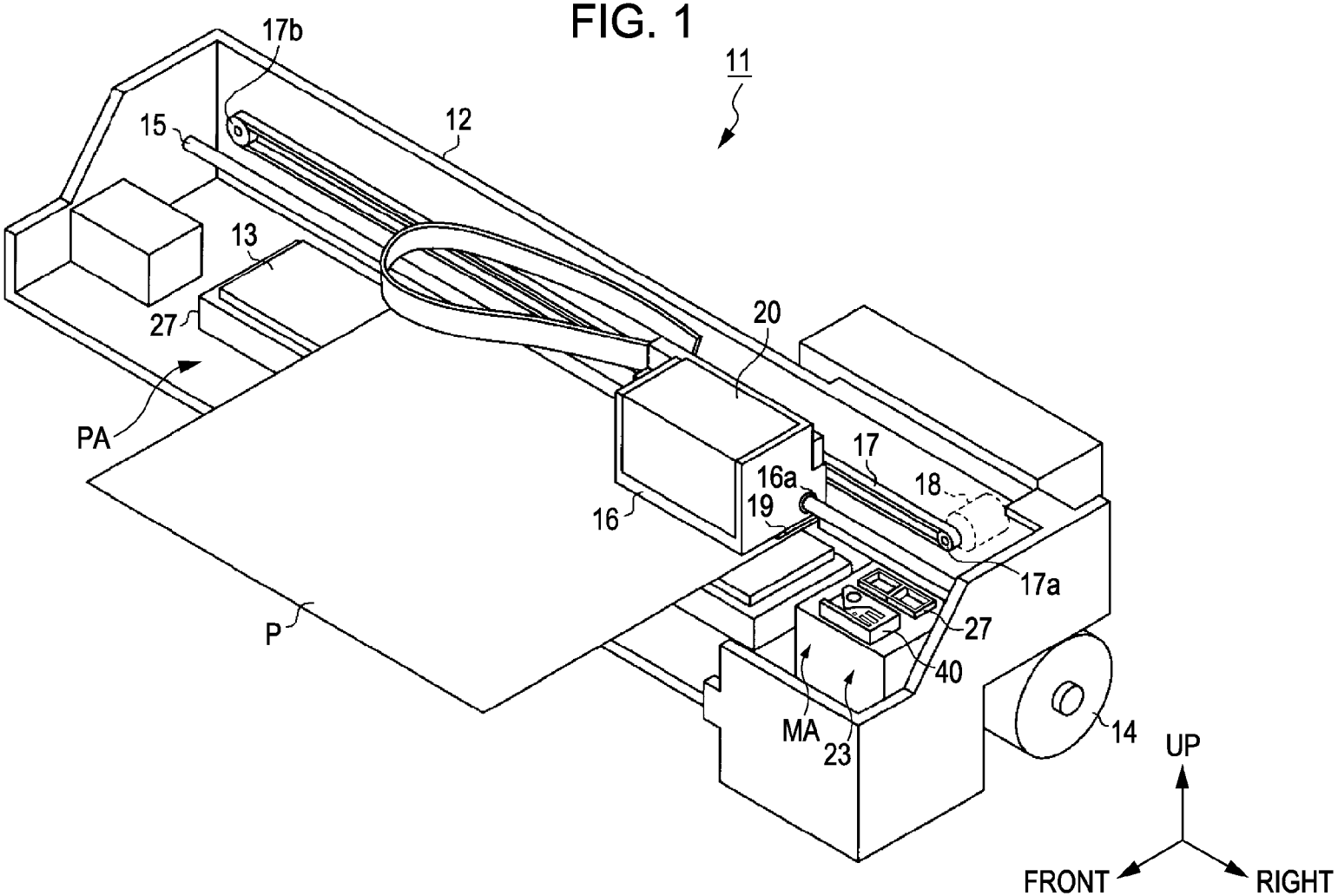
FIG. 1 is a perspective view illustrating an ink jet printer according to a first embodiment.

As illustrated in FIG. 1, an ink jet printer 11 as a fluid ejecting apparatus includes a frame 12 having a substantially rectangular box shape. In a lower portion of the frame 12, a platen 13 extends along the left and the right direction which is the longitudinal direction. On the platen 13, a printing sheet P is fed by a paper feed mechanism not shown from the rear side as a paper feed motor 14 provided below a rear surface of the frame 12 is driven.

Above the platen 13 in the frame 12, a guide shaft 15 is mounted along the longitudinal direction of the platen 13. A carriage 16 is supported by the guide shaft 15 to reciprocate along the axial direction (left and right direction) of the guide shaft 15. That is, supporting holes 16*a* are formed to penetrate the carriage 16 in the left and right direction, and the guide shaft 15 is inserted through the supporting holes 16*a* such that the carriage 16 is supported by the guide shaft 15 to reciprocate in the left and right direction.

On an inner surface of the rear wall of the frame 12, at positions corresponding to the both end portions of the guide shaft 15, a driving pulley 17*a* and a driven pulley 17*b* are rotatably supported. An output shaft of a carriage motor 18 as a driving source for reciprocating the carriage 16 is connected to the driving pulley 17*a*, and an endless timing belt 17 of which a portion is connected to the carriage 16 is hung between the pair of the pulleys 17*a* and 17*b*. Therefore, the carriage 16 is moved in the left and right direction by the driving force of the carriage motor 18 via the endless timing belt 17 while being guided by the guide shaft 15.

Figure 2:
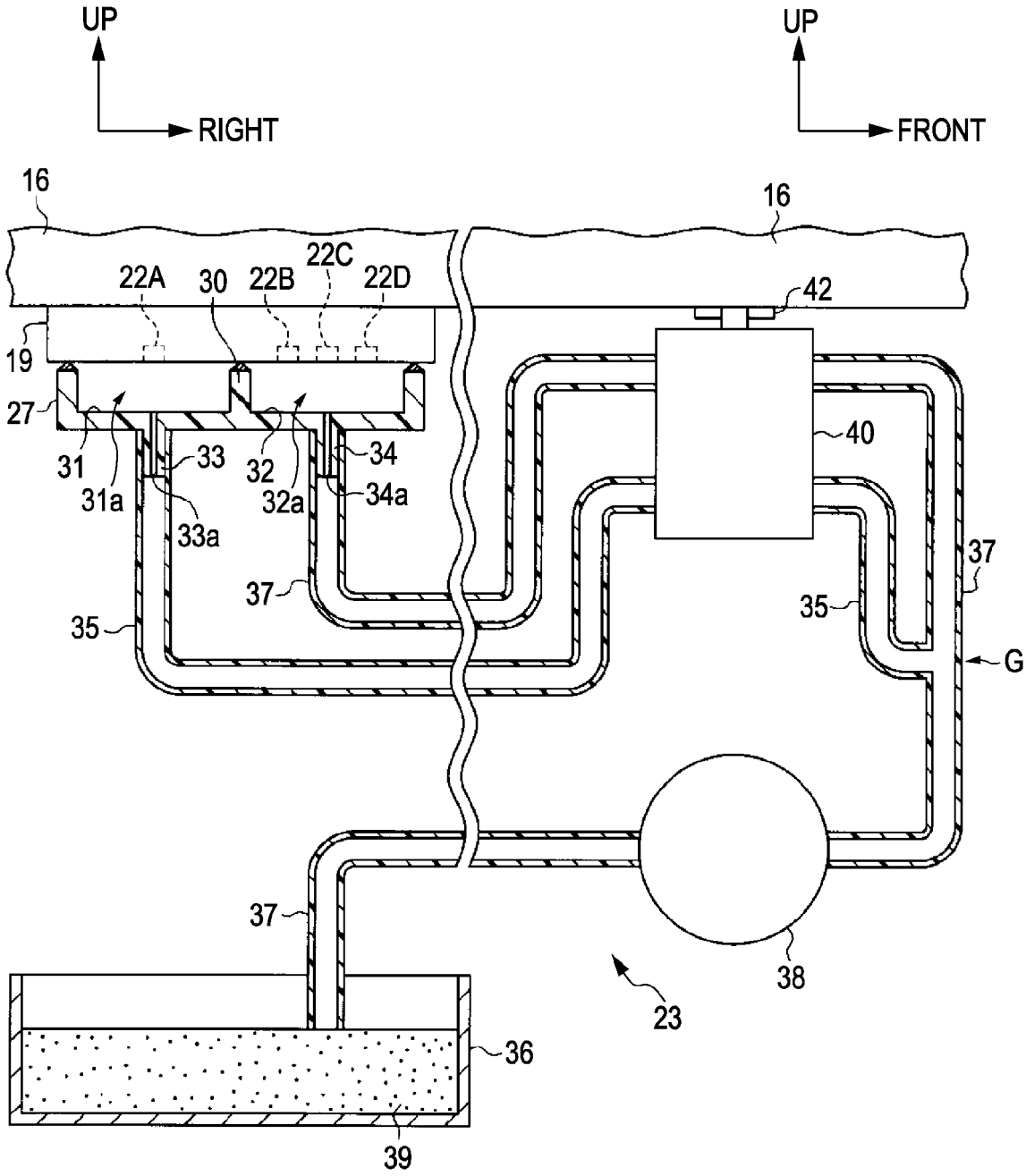
FIG. 2 is a cross-sectional view schematically illustrating a maintenance mechanism of the printer.
Figure 3:
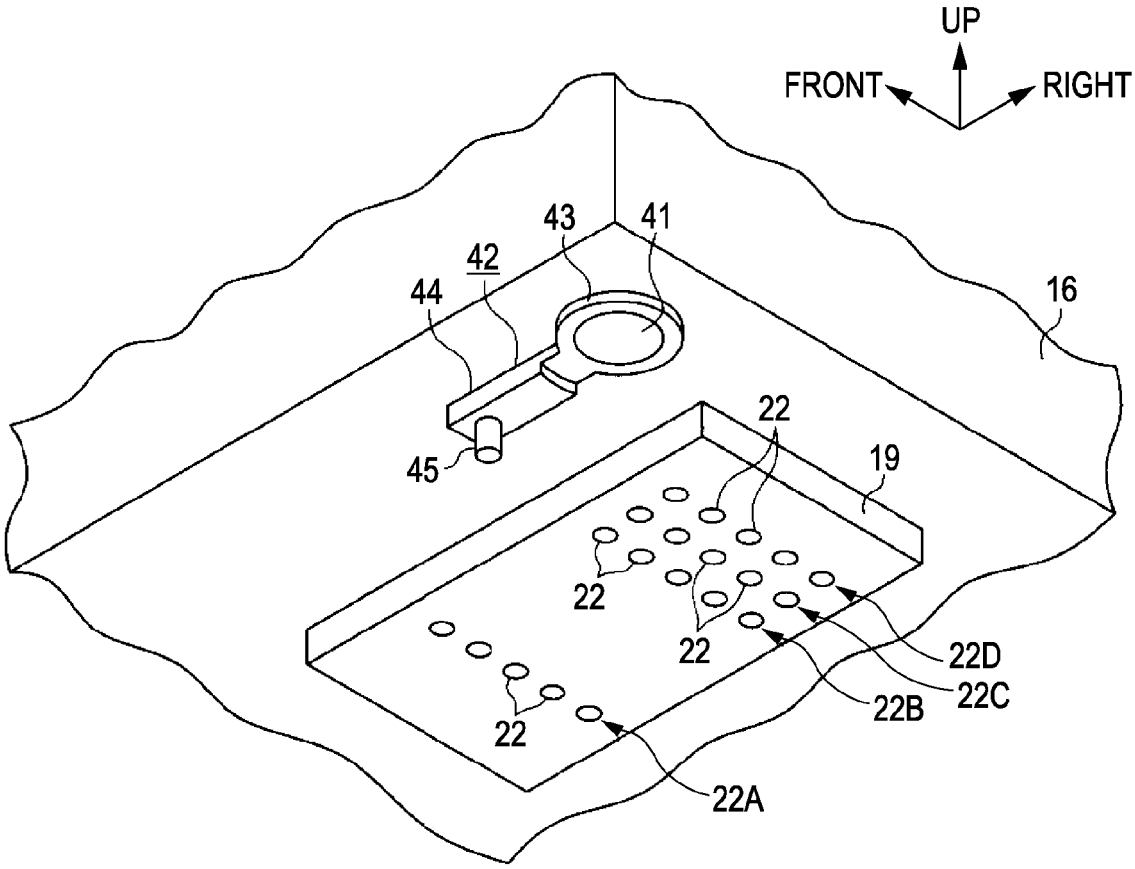
FIG. 3 is an expanded perspective view illustrating the main section of a carriage of the printer.

At a lower surface of the carriage 16, a print head 19 is mounted as a fluid ejecting head, and on the carriage 16, an ink cartridge 20 for supplying inks with a plurality of colors (in this embodiment, four colors: black, cyan, yellow, and magenta) as fluids is mounted to be attached to or detached from the print head 19. As illustrated in FIGS. 2 and 3, at a lower surface of the print head 19, a plurality of (in this embodiment, four) nozzle rows 22A to 22D in each of which a plurality of (in this embodiment, five) nozzles 22 are lined in the front and rear direction are arranged in the left and right direction.

The nozzle rows 22A to 22D are arranged in the order of the nozzle row 22A, the nozzle row 22B, the nozzle row 22C, and the nozzle row 22D from the left. The interval between the nozzle rows 22B and 22C and the interval between the nozzle rows 22C and 22D are equal, and the interval between the nozzle rows 22A and 22B is greater than the interval between the nozzle rows 22B and 22C and the interval between the nozzle rows 22C and 22D.

In addition, each ink in the ink cartridge 20 is supplied to the print head 19 from the ink cartridge 20 by an operation of a piezoelectric element (not shown) provided in the print head 19 through the nozzles 22 of the nozzle rows 22A to 22D provided in the print head 19. Specifically, as illustrated in FIGS. 1 to 3, while the carriage 16 is reciprocated in the left and right direction in the printing area PA corresponding to the platen 13, inks are ejected onto a printing sheet P fed on the platen 13 by the operation of the piezoelectric element (not shown) provided in the print head 19, thereby performing printing.

In this case, the black ink is ejected from each nozzle 22 of the nozzle row 22A, the cyan ink is ejected from each nozzle 22 of the nozzle row 22B, the yellow ink is ejected from each nozzle 22 of the nozzle row 22C, and the magenta ink is ejected from each nozzle 22 of the nozzle row 22D.

In addition, a non-printing area at a right end portion of the frame 12, which does not correspond to the platen 13, serves as a maintenance area MA for maintenance such as cleaning of the print head 19 when printing is not performed. In the maintenance area MA, a maintenance mechanism 23 is provided.

Next, the configuration of the maintenance mechanism 23 will be described.

Figure 4:
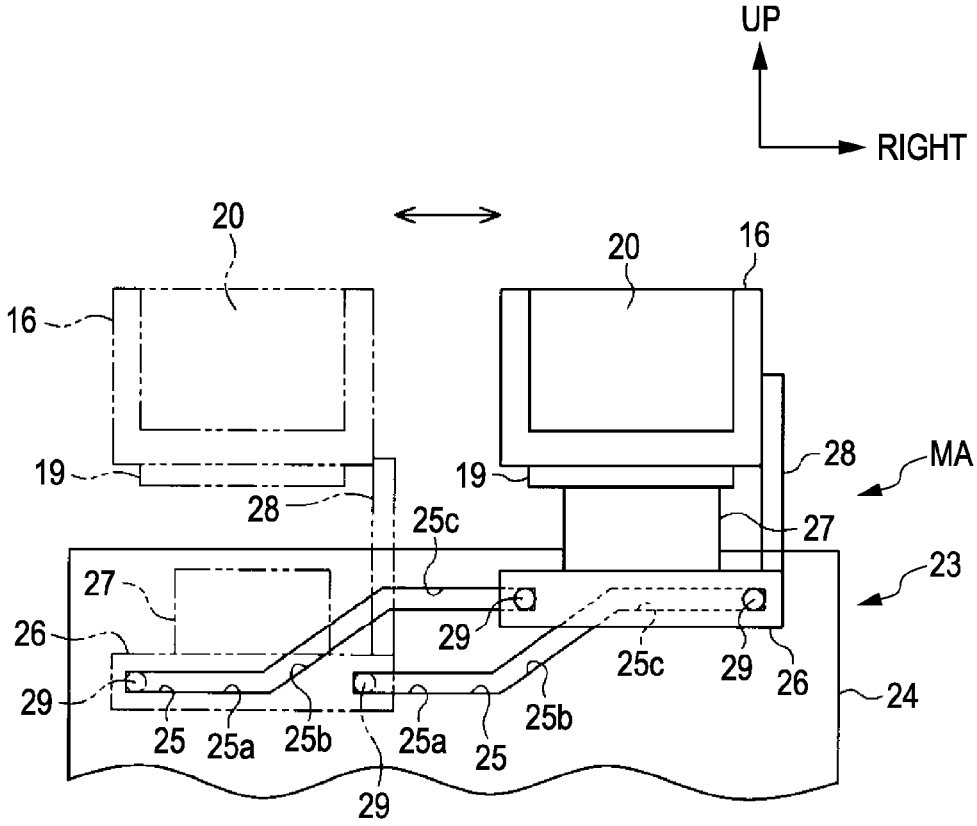
FIG. 4 is a schematic view illustrating a positional relationship between the carriage and a cap in a maintenance area of the printer.

As illustrated in FIG. 4, the maintenance mechanism 23 includes a pair of front and rear supporting plates 24, and two through-grooves 25 are lined as a set in both the supporting plates 24 in the front and rear direction. Each through-groove 25 includes a lower horizontal portion 25*a* extending straightly in a horizontal direction from the left to the right, an inclined portion 25*b* extending straightly while being inclined upwardly to the right from the right end of the lower horizontal portion 25*a*, and an upper horizontal portion 25*c* extending straightly in the horizontal direction to the right from the right end of the inclined portion 25*b*.

In each through-groove 25, the lower horizontal portion 25*a*, the inclined portion 25*b*, and the upper horizontal portion 25*c* are connected to one another. In addition, in the set of the through-grooves 25 lined in the both supporting plates 24 in the front and rear direction, the lower horizontal portion 25*a* of one (the through-groove 25 on the right) and the upper horizontal portion 25*c* of the other (the through-groove 25 on the left) overlap with each other in the up and down direction.

A cap holder 26 having a rectangular plate shape is disposed between the both supporting plates 24, and a cap 27 having a bottomed rectangular box shape is provided at the center of the upper surface of the cap holder 26 as a cap member for configuring a cap unit. In addition, on a right end portion of the upper surface of the cap holder 26, an engagement bar 28 which engages with the right surface of the carriage 16 when the carriage 16 is moved to the maintenance area MA stands.

Supporting bars 29 extending in the front and rear directions are provided in the left and right end portions of the cap holder 26. In addition, both front end portions of the supporting bars 29 are slidably inserted into the through-grooves 25 on the front side of the both supporting plates 24, and both rear end portions of the supporting bars 29 are slidably inserted into the through-grooves 25 on the rear side of the both supporting plates 24. The cap holder 26 is always biased to the left by a spring (not shown). In the printing state where the carriage 16 is not positioned in the maintenance area MA, by the biasing force of the spring, both the supporting bars 29 are disposed at positions (positions shown by dot-dot-dashed lines of FIG. 4) that come in contact with the leftmost surfaces of the lower horizontal portions 25*a* of the respective through-grooves 25 along with the cap 27.

In addition, when the carriage 16 is moved to the maintenance area MA, the right surface of the carriage 16 comes in contact with the engagement bar 28, and when the carriage 16 is further moved to the right, both the supporting bars 29 slide to the right of the lower horizontal portions 25*a* of the respective through-grooves 25 against the biasing force of the spring (not shown). In the process in which both the supporting bars 29 slide to the right of the inclined portions 25*b* of the respective through-grooves 25 as the carriage 16 is further moved to the right, the cap 27 is slowly lifted to approach the print head 19 along with the cap holder 26, and in the stage in which both the supporting bars 29 reach the upper horizontal portions 25*c* of the respective through-grooves 25, the cap 27 comes in contact with the print head 19.

In addition, in the maintenance state (the state shown by full lines of FIG. 4) where the cap holder 26 is disposed at the home position that is the rightmost position of the carriage 16, both the supporting bars 29 are disposed at positions (positions shown by the full lines of FIG. 4) that come in contact with the rightmost surfaces of the upper horizontal portions 25*c* of the respective through-grooves 25 along with the cap 27.

As illustrated in FIG. 2, in the cap 27, a barrier 30 for partitioning the inside of the cap 27 into two left and right chambers is disposed. In the cap 27, the left portion from the barrier 30 is referred to as a first cap portion 31, and the right portion from the barrier 30 is referred to as a second cap portion 32. In addition, in the maintenance state where the carriage 16 is disposed at the home position, the cap 27 comes in contact with the print head 19 to enclose the nozzles 22.

Specifically, in the state where the cap 27 comes in contact with the print head 19, the first cap portion 31 forms a first cap internal space 31*a* with the print head 19 while enclosing the nozzle row 22A, and the second cap portion 32 forms a second cap internal space 32*a* with the print head 19 while enclosing the nozzle rows 22B to 22D.

From the bottom wall of the first cap portion 31, a first protruding portion 33 protrudes downward, and in the first protruding portion 33, a first discharge passage 33*a* for discharging ink from the first cap portion 31 penetrates in the up and down direction. From the bottom wall of the second cap portion 32, a second protruding portion 34 protrudes downward, and in the second protruding portion 34, a second discharge passage 34*a* for discharging ink from the second cap portion 32 penetrates in the up and down direction.

A base end side (upstream side) of a second discharge tube 37 as a tube having flexibility is connected to the second protruding portion 34, and the other end side (downstream side) of the second discharge tube 37 is inserted into a waste ink tank 36 having a rectangular parallelepiped shape. In addition, a base end side (upstream side) of a first discharge tube 35 as a tube having flexibility is connected to the first protruding portion 33, and the other end side (downstream side) of the first discharge tube 35 is connected to the center portion of the second discharge tube 37 for confluence.

Both the discharge tubes 35 and 37 extend to the junction G therebetween and are drawn, and at a position of the second discharge tube 37 on the downstream side from the junction G with the first discharge tube 35, a tube pump 38 is disposed as a suction unit for sucking the inside of the second discharge tube 37 from the cap 27 toward the waste ink tank 36.

That is, when the tube pump 38 is operated, the insides of the both discharge tubes 35 and 37 are simultaneously sucked. Therefore, the first and second discharge tubes 35 and 37 form suction passages for sucking the first and second cap internal spaces 31*a* and 32*a*, respectively.

In addition, as the tube pump 38 is operated in the state where the cap 27 comes in contact with the print head 19, inks that have thickened from the nozzles 22 (refer to FIG. 3) of each of the nozzle rows 22A to 22D are sucked along with air bubbles and discharged into the waste ink tank 36 via the cap 27 and both the discharge tubes 35 and 37, that is, subjected to so-called cleaning. In addition, in the waste ink tank 36, a waste ink absorbing material 39 for absorbing, storing, and maintaining the inks discharged into the waste ink tank 36 is accommodated.

In addition, at positions of both the discharge tubes 35 and 37 on the upstream side from the junction G thereof, a valve unit 40 having a rectangular parallelepiped shape is disposed to selectively block both the discharge tubes 35 and 37. The valve unit 40 is configured as a part of the maintenance mechanism 23 and disposed in front of the cap 27 in the maintenance area MA.

In addition, in FIG. 2, for easy understanding, the left side and the right side from the break lines as the boundary are given different directions. That is, in FIG. 2, on the left from the break lines, the carriage 16 is moved in the left and right direction, and on the right from the break lines, the carriage 16 is moved in a direction perpendicular to the paper surface.

As illustrated in FIG. 3, on a right end portion of the lower surface of the carriage 16, a disc-shaped convex portion 41 is disposed at a position in front of the print head 19, and a swing member 42 is swingably supported by the convex portion 41. Specifically, the swing member 42 includes a ring-shaped annular portion 43 and an arm portion 44 that straightly extends to the left from the annular portion 43 and has a rectangular plate shape, and the annular portion 43 is swingably fitted to the convex portion 41. In addition, on the lower surface of a front end portion of the arm portion 44, a pin portion 45 is formed as a columnar blocking member protruding downward. In addition, in this embodiment, the valve unit 40 and the swing member 42 constitute a selective blocking unit.

Next, the configuration of the valve unit 40 will be described.

Figure 5:
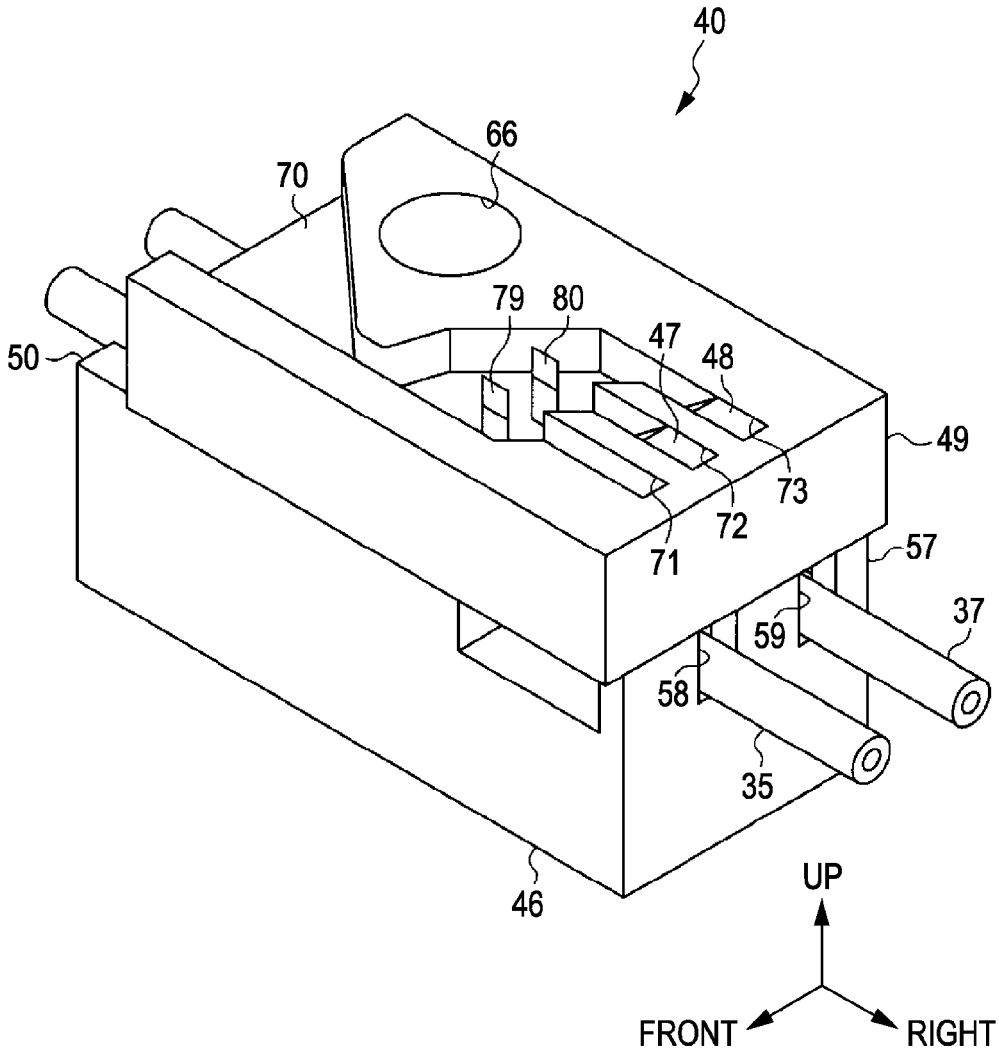
FIG. 5 is a perspective view illustrating a valve unit of the printer.
Figure 6:
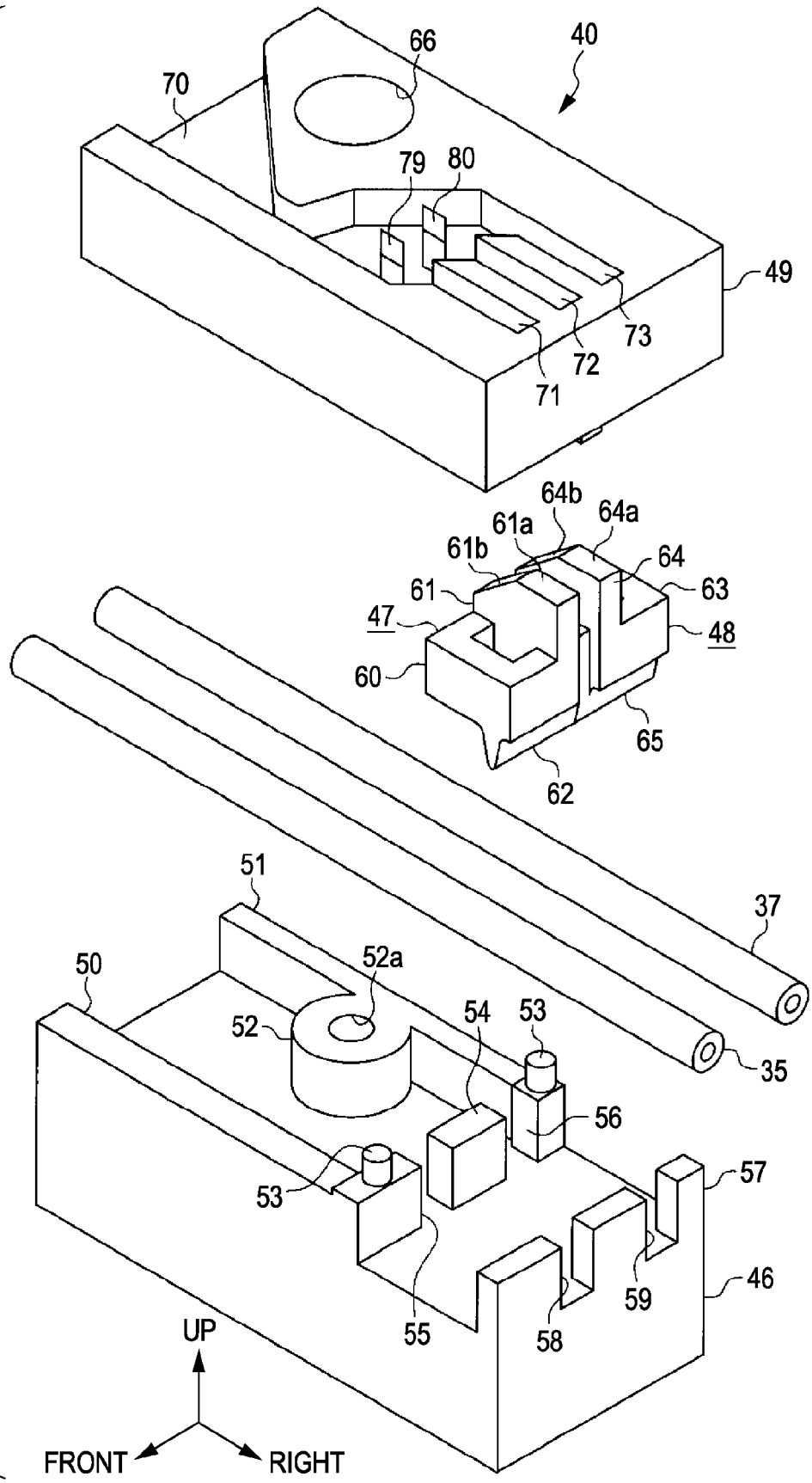
FIG. 6 is an exploded perspective view of FIG. 5.

As illustrated in FIGS. 5 and 6, the valve unit 40 includes a case member 46 having a substantially rectangular parallelepiped shape for supporting the intermediate portions of both the discharge tubes 35 and 37 extending in the front and rear direction, first and second pressing members 47 and 48 as pressing members for pressing parts of the first and second discharge tubes 35 and 37 which are supported on the upper surfaces of the case member 46, and a cover member 49 which accommodates the both pressing members 47 and 48 and covers the upper surface of the case member 46.

On the front and rear edge portions of the upper surface of the case member 46, front and rear walls 50 and 51 stand from almost the center portion to the left end of the upper surface in the left and right direction. In front of the rear wall 51 on the upper surface of the case member 46, stands a circular boss portion 52 which is close to the center portion of the rear wall 51 in the left and right direction and of which the center portion has a threaded hole 52*a*. On the right end portions of the upper surfaces of the front and rear walls 50 and 51, stand columnar protrusions 53, and both the protrusions 53 are able to be fitted to corresponding recessed portions (not shown) provided in the lower surface of the cover member 49.

On the upper surface of the case member 46, stands an island portion 54 which has a rectangular parallelepiped shape and the same height as the front and rear walls 50 and 51 at a position between the right end portions of the front and rear walls 50 and 51. In this case, a gap 55 is formed between the island portion 54 and the right end portion of the front wall 50, and a gap 56 is formed between the island portion 54 and the right end portion of the rear wall 51. In addition, on the right edge portion of the upper surface of the case member 46, a right wall 57 having the same height as the front and rear walls 50 and 51 is formed. At positions corresponding to the gaps 55 and 56 of the right wall 57 in the left and right direction cut-off recessed portions 58 and 59 are formed by cutting the right wall 57.

In addition, in the state where the first and second discharge tubes 35 and 37 are supported on the upper surface of the case member 46, the first discharge tube 35 passes through the gap 55 and the cut-off recessed portion 58, and the second discharge tube 37 passes through the gap 56 and the cut-off recessed portion 59. Therefore, the position of the first discharge tube 35 in the front and rear direction is determined between the gap 55 and the cut-off recessed portion 58, and the position of the second discharge tube 37 in the front and rear direction is determined between the gap 56 and the cut-off recessed portion 59.

The first pressing member 47 has a main body portion 60 with a block shape, and a projecting portion 61 having a plate shape is provided on the rear edge portion of the upper surface of the main body portion 60. An upper surface 61*a* of the projecting portion 61 is horizontal, and an inclined surface 61*b* is formed adjacent to the upper surface 61*a* on the left from the upper surface 61*a*. The inclined surface 61*b* is inclined upwardly toward the upper surface 61*a*. The right end portion of the lower surface of the main body portion 60 is provided with a convex strip 62 protruding downward and extending in the front and rear direction.

With regard to the convex strip 62, the width in the left and right direction gradually decreases toward the tip end portion (lower end portion), and the tip end (lower end) is circular. In addition, the tip end of the convex strip 62 comes in contact with the upper surface of the first discharge tube 35 between the gap 55 and the cut-off recessed portion 58 in the case member 46.

In addition, the second pressing member 48 has a main body portion 63 with a block shape, and a projecting portion 64 having a plate shape is provided on the front edge portion of the upper surface of the main body portion 63. An upper surface 64*a* of the projecting portion 64 is horizontal, and an inclined surface 64*b* is formed adjacent to the upper surface 64*a* on the left from the upper surface 64*a*. The inclined surface 64*b* is inclined upwardly toward the upper surface 64*a*. The right end portion of the lower surface of the main body portion 63 is provided with a convex strip 65 protruding downward and extending in the front and rear direction.

With regard to the convex strip 65, the width in the left and right direction gradually decreases toward the tip end portion (lower end portion), and the tip end (lower end) is circular. In addition, the tip end of the convex strip 65 comes in contact with the upper surface of the second discharge tube 37 between the gap 56 and the cut-off recessed portion 59 on the case member 46.

In addition, the first and second pressing members 47 and 48 have shapes that are symmetrical with respect to the vertical plane stretching in the up and down direction and the left and right direction as a symmetry plane.

Figure 7:
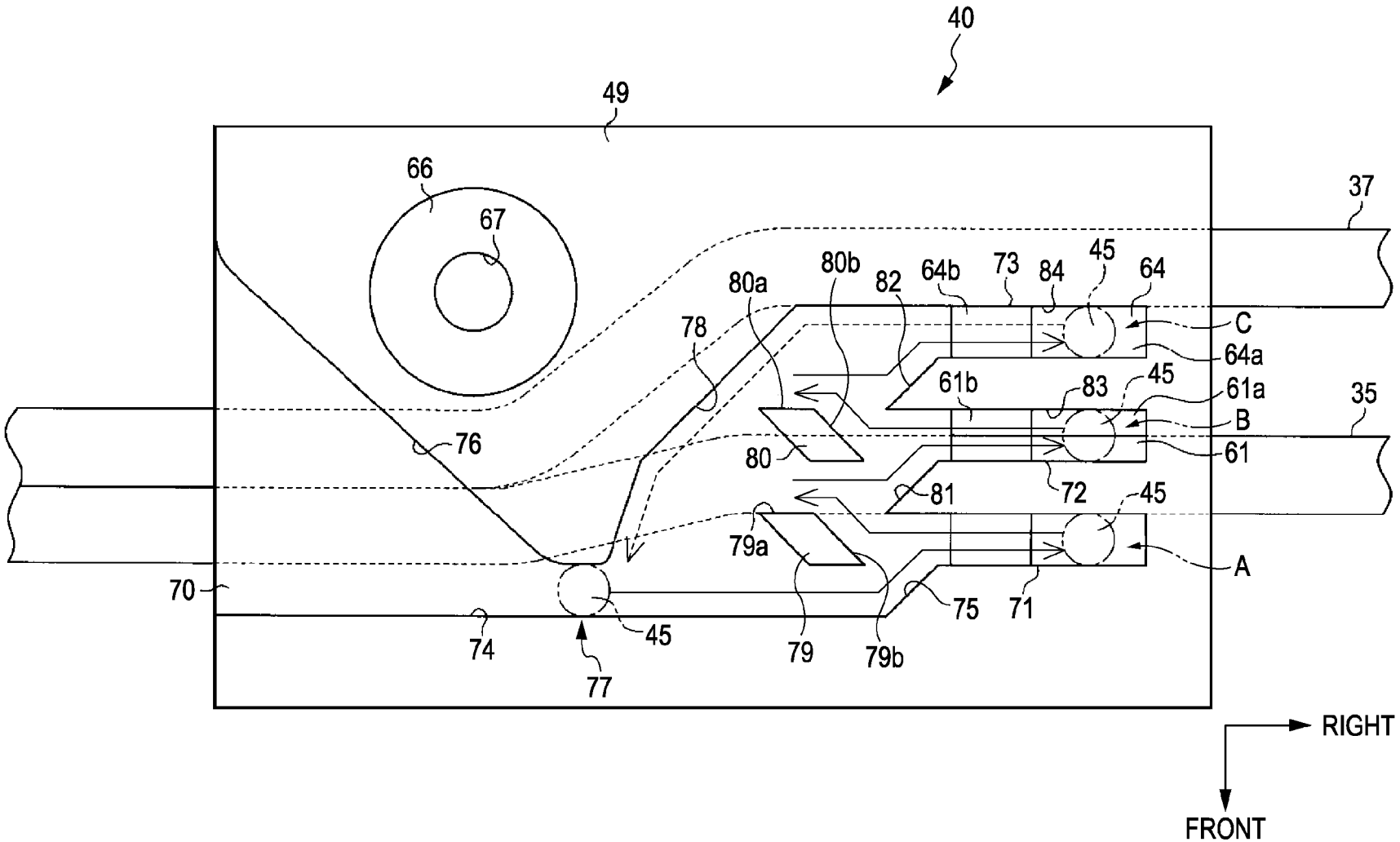
FIG. 7 is a plan view of FIG. 5.

As illustrated in FIGS. 6 and 7, a circular threaded recessed portion 66 is provided in the upper surface of the cover member 49 at a position corresponding to the boss portion 52 of the case member 46. A through-hole 67 penetrating the cover member 49 in the up and down direction is provided at the center of the bottom surface of the threaded recessed portion 66. Therefore, in a state where a screw (not shown) is inserted into the through-hole 67, as the screw is screwed to the threaded hole 52*a* of the boss portion 52 of the case member 46, the cover member 49 is fixed to the case member 46.

On the upper surface of the cover member 49, a long groove 70 is formed entirely in the left and right direction, and the groove 70 widely opens to the left end side and is blocked on the right end side. The right end portion of the groove 70 is formed as dead end portions 71 to 73 as three selection paths which are parallel at even intervals in the front and rear direction and each of which has a long rectangular shape in the left and right direction in a plan view. The dead end portions 71 to 73 are arranged in the order of the dead end portion 71, the dead end portion 72, and the dead end portion 73 from the front side, and the width of each of the dead end portions 71 to 73 in the front and rear direction is slightly greater than the outside diameter of the pin portion 45 of the swing member 42.

A front side surface 74 of the groove 70 straightly extends to the left from the front end portion of the left edge of the upper surface of the cover member 49, is inclined to the rear right at a position slightly on the right from the center portion of the cover member 49 in the left and right direction, and then serves as the front side surface of the dead end portion 71. In this case, the inclined portion of the front side surface 74 of the groove 70 is referred to as an inclined surface 75.

A rear side surface 76 of the groove 70 extends diagonally to the front right from the rear end portion of the left edge of the upper surface of the cover member 49, becomes closest to the front side surface 74 at a position slightly on the left from the center portion of the cover member 49 in the left and right direction, is inclined to the rear right by two steps, and then extends straightly to the right to serve as the rear side surface of the dead end portion 73.

In this case, a portion of the groove 70 where the front side surface 74 and the rear side surface 76 are closest to each other is a constricted portion 77, and the width of the constricted portion 77 in the front and rear direction is slightly greater than the outside diameter of the pin portion 45 of the swing member 42. In this case, a portion of the rear side surface 76 of the groove 70 which is inclined at the second step, is referred to as a return surface 78.

In the groove 70, in the vicinity of the left sides of the dead end portions 71 and 72, first and second guiding portions 79 and 80, each of which has a parallelogram shape in a plan view, stand so as to correspond to the dead end portions 71 and 72. The first and second guiding portions 79 and 80 have the same shape, and the positions thereof in the left and right direction are the same. The upper surfaces of the first and second guiding portions 79 and 80 are flush with the upper surface of the cover member 49. The widths of the first and second guiding portions 79 and 80 in the front and rear direction are almost the same as the widths of the dead end portions 71 and 72 in the front and rear direction.

The rear side surface of the first guiding portion 79 is a straight surface 79*a* extending in the left and right direction in a plan view. The right side surface of the first guiding portion 79 is a first cam surface 79*b* which faces the dead end portion 71 and extends diagonally to the rear left from the front right in the plan view. In addition, the rear side surface of the second guiding portion 80 is a straight surface 80*a* extending in the left and right direction in the plan view. The right side surface of the second guiding portion 80 is a second cam surface 80*b* which faces the dead end portion 72 and extends diagonally to the rear left from the front right in the plan view.

The left side surface of the barrier between the dead end portions 71 and 72 is a third cam surface 81 extending diagonally to the rear right from the front left in the plan view, and the left side surface of the barrier between the dead end portions 72 and 73 is a fourth cam surface 82 extending diagonally to the rear right from the front left in the plan view.

Almost the entire portion of the bottom wall of the dead end portion 72 is provided with an insertion hole 83 penetrating the cover member 49 in the up and down direction, and the projecting portion 61 of the first pressing member 47 is inserted into the insertion hole 83 from below. In this case, the upper surface 61*a* of the projecting portion 61 is at a height slightly lower than the upper surface of the cover member 49. In addition, almost the entire portion of the bottom wall of the dead end portion 73 is provided with an insertion hole 84 penetrating the cover member 49 in the up and down direction, and the projecting portion 64 of the second pressing member 48 is inserted into the insertion hole 84*n* from below. In this case, the upper surface 64*a* of the projecting portion 64 is at a height slightly lower than the upper surface of the cover member 49.

In addition, when the carriage 16 is moved in the maintenance area MA, the pin portion 45 of the swing member 42 slides in the groove 70. In addition, in the case where the carriage 16 is moved to the home position, the position of the pin portion 45 when the pin portion 45 of the swing member 42 is in the dead end portion 71 is referred to as a non-blocking position A, the position of the pin portion 45 when the pin portion 45 is in the dead end portion 72 is referred to as a blocking position B, and the position of the pin portion 45 when the pin portion 45 is in the dead end portion 73 is referred to as a blocking position C.

Figure 8A:
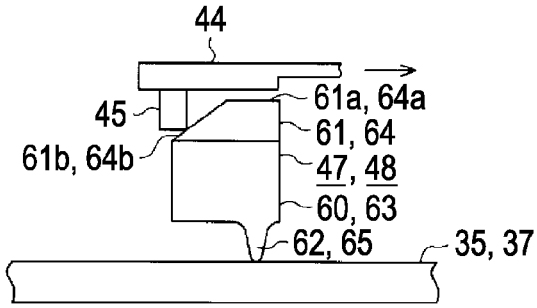
FIG. 8A is a schematic view illustrating a state where a pin portion of a swing member comes in contact with an inclined surface of a first or second pressing member.
Figure 8B:
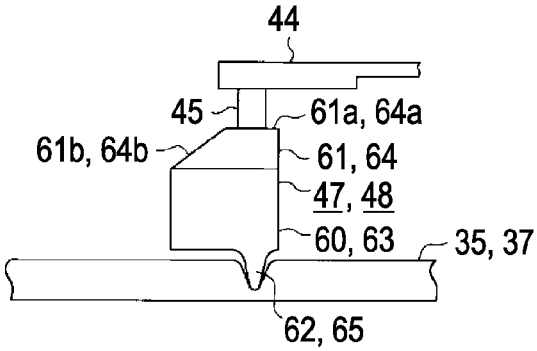
FIG. 8B is a schematic view illustrating a state where the pin portion of the swing member presses and crushes a first or second discharge tube via the first or second pressing member.

In addition, when the pin portion 45 of the swing member 42 is at the blocking position B, as illustrated in FIG. 8B, the pin portion 45 presses the first discharge tube 35 with the first pressing member 47 interposed therebetween so as to be crushed, so that the inside of the first discharge tube 35 is blocked. In addition, when the pin portion 45 of the swing member 42 is at the blocking position C, as illustrated in FIG. 8B, the pin portion 45 presses the second discharge tube 37 with the second pressing member 48 interposed therebetween so as to be crushed, so that the inside of the second discharge tube 37 is blocked.

Next, the operation of the ink jet printer 11 during cleaning will be described.

Entire Cleaning

However, in the case where the entire cleaning of the print head 19 for sucking inks from the nozzles 22 of the entire nozzle rows 22A to 22D is performed, first, the carriage 16 is moved to the home position in the maintenance area MA. Then, the cap 27 comes in contact with the print head 19, the first cap portion 31 forms the first cap internal space 31*a* with the print head 19 while enclosing the nozzle row 22A, and at the same time, the second cap portion 32 forms the second cap internal space 32*a* with the print head 19 while enclosing the nozzle rows 22B to 22D.

In addition, the pin portion 45 of the swing member 42 enters into the groove 70 provided in the upper surface of the cover member 49 of the valve unit 40 from the left. Here, since the left end opening of the groove 70 is wide, although the position of the pin portion 45 is slightly deviated from the front and rear direction, the pin portion 45 is guided to the constricted portion 77 by the rear side surface 76 of the groove 70. Next, the pin portion 45 is moved to the non-blocking position A in the dead end portion 71 along the front side surface 74 of the groove 70.

When the pin portion 45 is at the non-blocking position A, neither of the discharge tubes 35 and 37 are in the blocked state. When the tube pump 38 is operated in this state, the insides of the both discharge tubes 35 and 37 are simultaneously sucked, and negative pressures occur in the first and second cap internal spaces 31*a* and 32*a*.

Due to the negative pressure, the black ink that has thickened is sucked from each nozzle 22 of the nozzle row 22A along with air bubbles, and discharged into the waste ink tank 36 via the first cap portion 31 and the first discharge tube 35. At the same time, the cyan ink, the yellow ink, and the magenta ink that have thickened are sucked from the nozzles 22 of the nozzle rows 22B to 22D along with air bubbles and discharged into the waste ink tank 36 via the second cap portion 32 and the second discharge tube 37. By this operation, the entire cleaning procedure for sucking inks from each nozzle 22 of the entire nozzle rows 22A to 22D of the print head 19 is completed.

Thereafter, when printing is performed, the carriage 16 may be moved to the printing area PA. Here, the pin portion 45 of the swing member 42 slides along the first cam surface 79*b* and the straight surface 79*a* of the first guiding portion 79, as well as the return surface 78 of the groove 70, passes through the constricted portion 77, and separates from the groove 70 through the left end opening of the groove 70.

Selective Cleaning

In the case where selective cleaning of the print head 19 for sucking inks (color inks) from the nozzles 22 of the nozzle rows 22B to 22D from among all of the nozzle rows 22A to 22D is performed, from the state where the carriage 16 is at the home position and thus the pin portion 45 is at the non-blocking position A, the carriage 16 is additionally moved to the left.

Then, the pin portion 45 slidably comes in contact with the first cam surface 79*b* of the first guiding portion 79 and slides across the first cam surface 79*b* toward the straight surface 79*a*. Then, when the carriage 16 is moved to the right after the pin portion 45 is moved onto the straight surface 79*a*, the pin portion 45 slidably comes in contact with the third cam surface 81 and slides across the third cam surface 81 toward the dead end portion 72. Thereafter, when the carriage 16 is moved again to the home position, the pin portion 45 is moved to the blocking position B in the dead end portion 72.

Here, as illustrated in FIG. 8A, the pin portion 45 slides across the inclined surface 61*b* of the projecting portion 61 of the first pressing member 47 and thus slowly lowers the first pressing member 47 as the sliding proceeds. In addition, in the state where the pin portion 45 is moved to the blocking position B, as illustrated in FIG. 8B, it is in the state of being completely placed on the upper surface 61*a* of the projecting portion 61 of the first pressing member 47. In this state, since the pin portion 45 completely presses down the first pressing member 47, the convex strip 62 of the first pressing member 47 completely crushes the first discharge tube 35 so as to block the inside of the first discharge tube 35.

When the tube pump 38 is operated in this state, the insides of the both discharge tubes 35 and 37 are simultaneously sucked. However, since the first discharge tube 35 is blocked by the first pressing member 47, a negative pressure occurs only in the second cap internal space 32*a* from among both the cap internal spaces 31*a* and 32*a*. Due to the negative pressure, the cyan ink, the yellow ink, and the magenta ink that have thickened are sucked from the nozzles 22 of the nozzle rows 22B to 22D along with air bubbles and discharged into the waste ink tank 36 via the second cap portion 32 and the second discharge tube 37. Accordingly, the selective cleaning of the print head 19 for sucking the inks (color inks) from the nozzles 22 of the nozzle rows 22B to 22D from among all of the nozzle rows 22A to 22D is completed.

Thereafter, when printing is performed, the carriage 16 may be moved to the printing area PA. Here, the pin portion 45 of the swing member 42 slides along the second cam surface 80*b* and the straight surface 80*a* of the second guiding portion 80, as well as the return surface 78 of the groove 70, passes through the constricted portion 77, and separates from the groove 70 through the left end opening of the groove 70.

Next, in the case where selective cleaning of the print head 19 for sucking black inks from the nozzles 22 of the nozzle row 22A from among all of the nozzle rows 22A to 22D is performed, from the state where the carriage 16 is at the home position and thus the pin portion 45 is at the blocking position B, the carriage 16 is additionally moved to the left. Then, the pin portion 45 slidably comes in contact with the second cam surface 80*b* of the second guiding portion 80 and slides across the second cam surface 80*b* toward the straight surface 80*a*.

Here, since the pin portion 45 separates from the dead end portion 72, the state where the first pressing member 47 is pressed down by the pin portion 45 is released. Accordingly, the first discharge tube 35 that is crushed by the first pressing member 47 is returned to its original shape, that is, the shape before being crushed, by its elastic restoring force. Therefore, the first pressing member 47 is pushed up by the first discharge tube 35, and returned to its original position, that is, the position before being pressed down by the pin portion 45 of the first pressing member 47. Correspondingly, the first discharge tube 35 is released from the blocked state but is in the opened state.

Then, when the carriage 16 is moved to the right after the pin portion 45 is moved onto the straight surface 80*a*, the pin portion 45 slidably comes in contact with the fourth cam surface 82 and slides across the fourth cam surface 82 toward the dead end portion 73. Thereafter, when the carriage 16 is moved again to the home position, the pin portion 45 is moved to the blocking position C in the dead end portion 73.

Here, as illustrated in FIG. 8A, the pin portion 45 slides across the inclined surface 64*b* of the projecting portion 64 of the second pressing member 48 and thus slowly lowers the second pressing member 48 as the sliding proceeds. In addition, in the state where the pin portion 45 is moved to the blocking position C, as illustrated in FIG. 8B, it is in the state of being completely placed on the upper surface 64*a* of the projecting portion 64 of the second pressing member 48. In this state, since the pin portion 45 completely presses down the second pressing member 48, the convex strip 65 of the second pressing member 48 completely crushes the second discharge tube 37 so as to block the inside of the second discharge tube 37.

When the tube pump 38 is operated in this state, the insides of the both discharge tubes 35 and 37 are simultaneously sucked. However, since the second discharge tube 37 is blocked by the second pressing member 48, a negative pressure occurs only in the first cap internal space 31*a* from among the both cap internal spaces 31*a* and 32*a*. Due to the negative pressure, the black inks that have thickened are sucked from the nozzles 22 of the nozzle row 22A along with air bubbles and discharged into the waste ink tank 36 via the first cap portion 31 and the first discharge tube 35. Accordingly, the selective cleaning of the print head 19 for sucking the black ink from the nozzles 22 of the nozzle row 22A from among all of the nozzle rows 22A to 22D is completed.

Thereafter, when printing is performed, the carriage 16 may be moved to the printing area PA. Here, the pin portion 45 of the swing member 42 slides along the return surface 78 of the groove 70, passes through the constricted portion 77, and separates from the groove 70 through the left end opening of the groove 70. In addition, since the pin portion 45 separates from the dead end portion 73, the state where the second pressing member 48 is pressed down by the pin portion 45 is released.

Accordingly, the second discharge tube 37 that is crushed by the second pressing member 48 is returned to its original shape, that is, the shape before being crushed, by its elastic restoring force. Therefore, the second pressing member 48 is pushed up by the second discharge tube 37, and returned to its original position, that is, the position before being pressed down by the pin portion 45 of the second pressing member 48. Correspondingly, the second discharge tube 37 is released from the blocked state but is in the opened state.

As described above, in the maintenance area MA, as the carriage 16 is reciprocated in the left and right direction from the home position as the starting point, the swing member 42 is swung by the operations of the cam surfaces 79*b*, 81, 80*b*, and 82, and thus the pin portion 45 of the swing member 42 is led from the non-blocking position A to the blocking position B and from the blocking position B to the blocking position C in this order in the front and rear direction which is perpendicular to the left and right direction that is the movement direction of the carriage 16 and which is also perpendicular to the up and down direction that is the direction in which the cap 27 comes in contact with the print head 19.

Specifically, the non-blocking position A, the blocking position B, and the blocking position C are set to correspond to the dead end portions 71 to 73, and one dead end portion into which the pin portion 45 of the swing member 42 is to enter is selected from among the dead end portions 71 to 73 by the reciprocating movement of the carriage 16 in the maintenance area MA, and the pin portion 45 enters into the selected dead end portion. The selection of the one dead end portion into which the pin portion 45 of the swing member 42 is to enter in this case is selected from one from the first and second discharge tubes 35 and 37 which is to be blocked by the pin portion 45. Therefore, the blocked states of the both discharge tubes 35 and 37 can be switched simply by the movement of the carriage 16.

Figure 9:
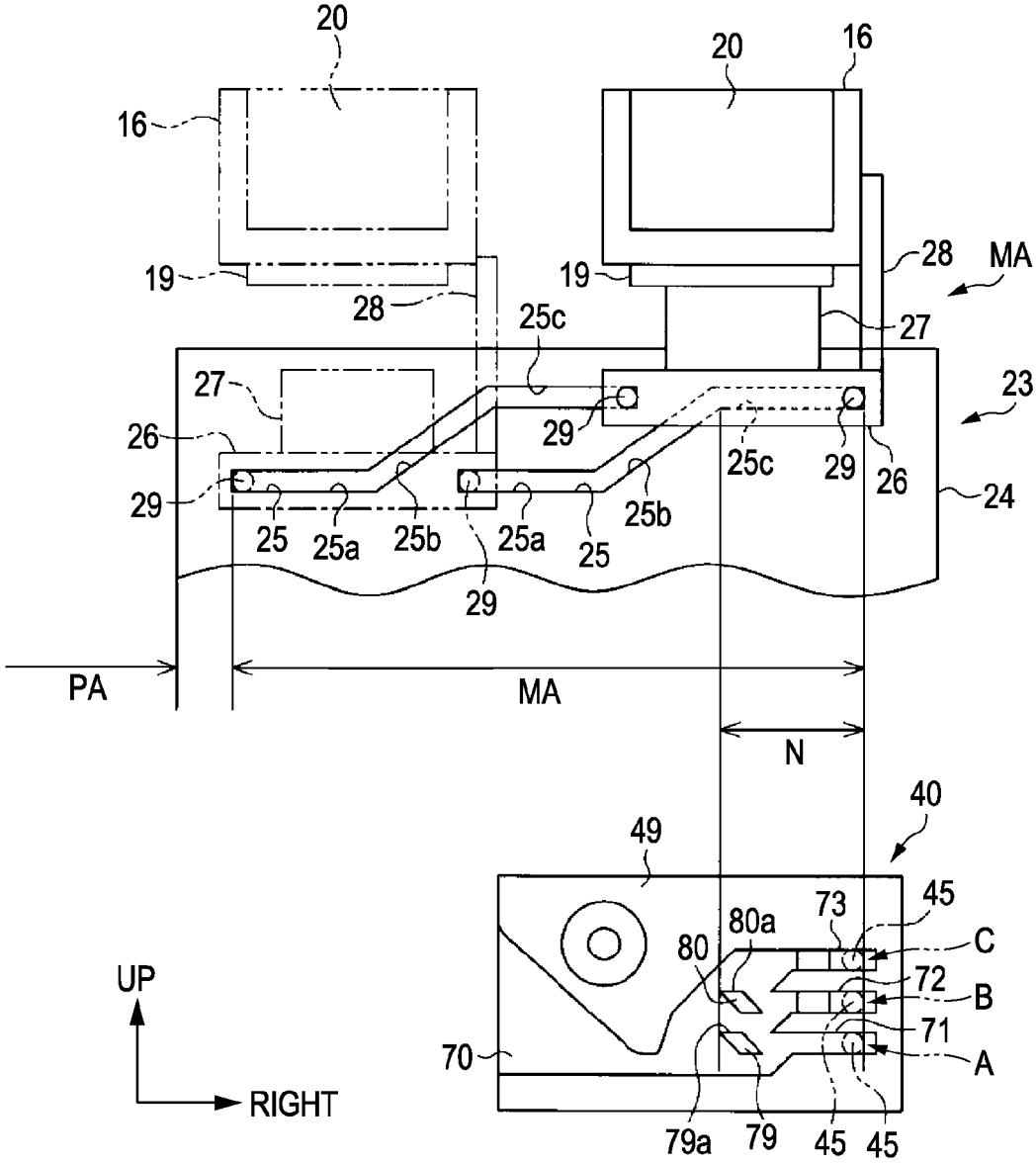
FIG. 9 is a schematic view illustrating a relationship between a reciprocating movement range of the carriage from a home position as a starting point in the maintenance area, and the length in the left and right direction of an upper horizontal portion in each through-groove of both supporting plates.

Here, as illustrated in FIG. 9, the reciprocating movement range of the carriage 16 from the home position as the starting point in the maintenance area MA is in the range of the lengths N in the left and right direction of the upper horizontal portions 25*c* of the through-grooves 25 of the both supporting plates 24. Accordingly, during the reciprocating movement of the carriage 16 from the home position as the starting point in the maintenance area MA, the supporting bar 29 of the cap holder 26 does not deviate from the corresponding upper horizontal portion 25*c*, so that the height of the cap holder 26 is not changed.

Therefore, since the height of the cap 27 is not changed during the reciprocating movement of the carriage 16 from the home position as the starting point in the maintenance area MA, the contacting state of the cap 27 with the print head 19 is maintained.

According to the first embodiment described above, the following effects can be obtained.

(1) In the maintenance area MA, the carriage 16 is reciprocated in the left and right direction from the home position as the starting point, so that the pin portion 45 of the swing member 42 can be led from the non-blocking position A to the blocking position B and from the blocking position B to the blocking position C by the operations of the cam surfaces 79*b*, 81, 80*b*, and 82 in the direction perpendicular to the movement direction of the carriage 16 and the direction in which the cap 27 comes in contact with the print head 19. That is, the blocked states of both the discharge tubes 35 and 37 can be switched as easily as the carriage 16 is reciprocated in the left and right direction in the existing maintenance area. Therefore, without extending the movement range of the carriage 16, the insides of the both discharge tubes 35 and 37 can be selectively blocked. As a result, without increasing the size of the ink jet printer 11, both the cap internal spaces 31*a* and 32*a* can be selectively sucked by the tube pump 38. Specifically, selective cleaning between the black ink and the color inks can be performed.

(2) Suction passages for sucking both the cap internal spaces 31*a* and 32*a* are configured as both the discharge tubes 35 and 37 having flexibility, and both the discharge tubes 35 and 37 are blocked as the pin portion 45 of the swing member 42 crushes both the discharge tubes 35 and 37 with both the pressing members 47 and 48 interposed therebetween. Accordingly, without a complex switch valve device, the insides of both the discharge tubes 35 and 37 can be selectively, easily, and reliably blocked. In addition, since the valve unit 40 has a simple configuration without the complex switch valve device, even when pigment inks that solidify easily are used as the inks, they are unlikely to clog up both the discharge tubes 35 and 37, and maintenance is not substantially necessary.

(3) When the carriage 16 is to be moved to the home position while being engaged with the engagement bar 28 in the maintenance area MA, in the process in which both the supporting bars 29 slide toward the inclined portions 25*b* of the through-grooves 25, the cap 27 is slowly lifted to approach the print head 19 along with the cap holder 26, and in the stage in which both the supporting bars 29 reach the upper horizontal portions 25*c* of the through-grooves 25, the cap 27 comes in contact with the print head 19. Therefore, without a driving source for allowing the cap 27 to come in contact with the print head 19, by the movement of the existing carriage 16, the cap 27 is allowed to come in contact with the print head 19.

(4) The reciprocating movement range of the carriage 16 from the home position as the starting point in the maintenance area MA for leading the pin portion 45 of the swing member 42 from the non-blocking position A to the blocking position B and from the blocking position B to the blocking position C in this order, is in the range of the lengths N in the left and right direction of the upper horizontal portions 25*c* of the through-grooves 25 of both the supporting plates 24. Accordingly, during the reciprocating movement of the carriage 16 from the home position as the starting point in the maintenance area MA, the supporting bar 29 of the cap holder 26 does not deviate from the corresponding upper horizontal portion 25*c*, so that the height of the cap holder 26 is not changed. That is, since the height of the cap 27 can be maintained during the reciprocating movement of the carriage 16 from the home position as the starting point in the maintenance area MA, the contacting state of the cap 27 with the print head 19 can be maintained.

Second Embodiment

Hereinafter, a second embodiment of the invention will be described mainly regarding differences thereof from the first embodiment.

Figure 10:
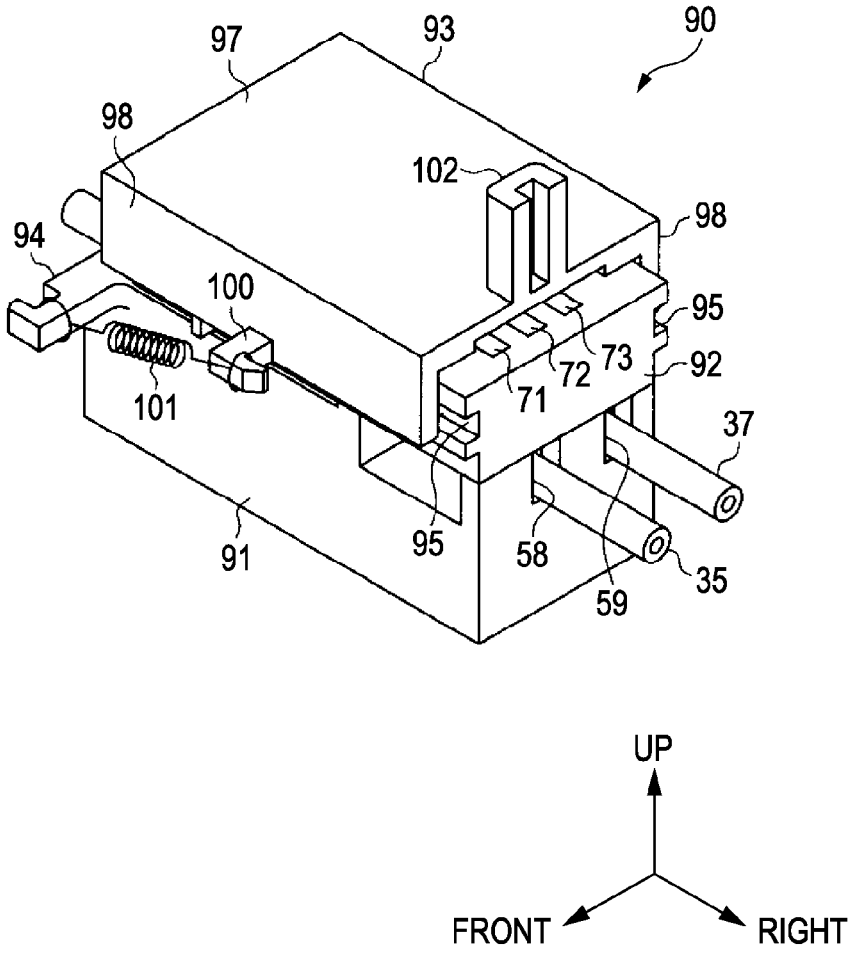
FIG. 10 is a perspective view illustrating a valve unit according to a second embodiment.
Figure 11:
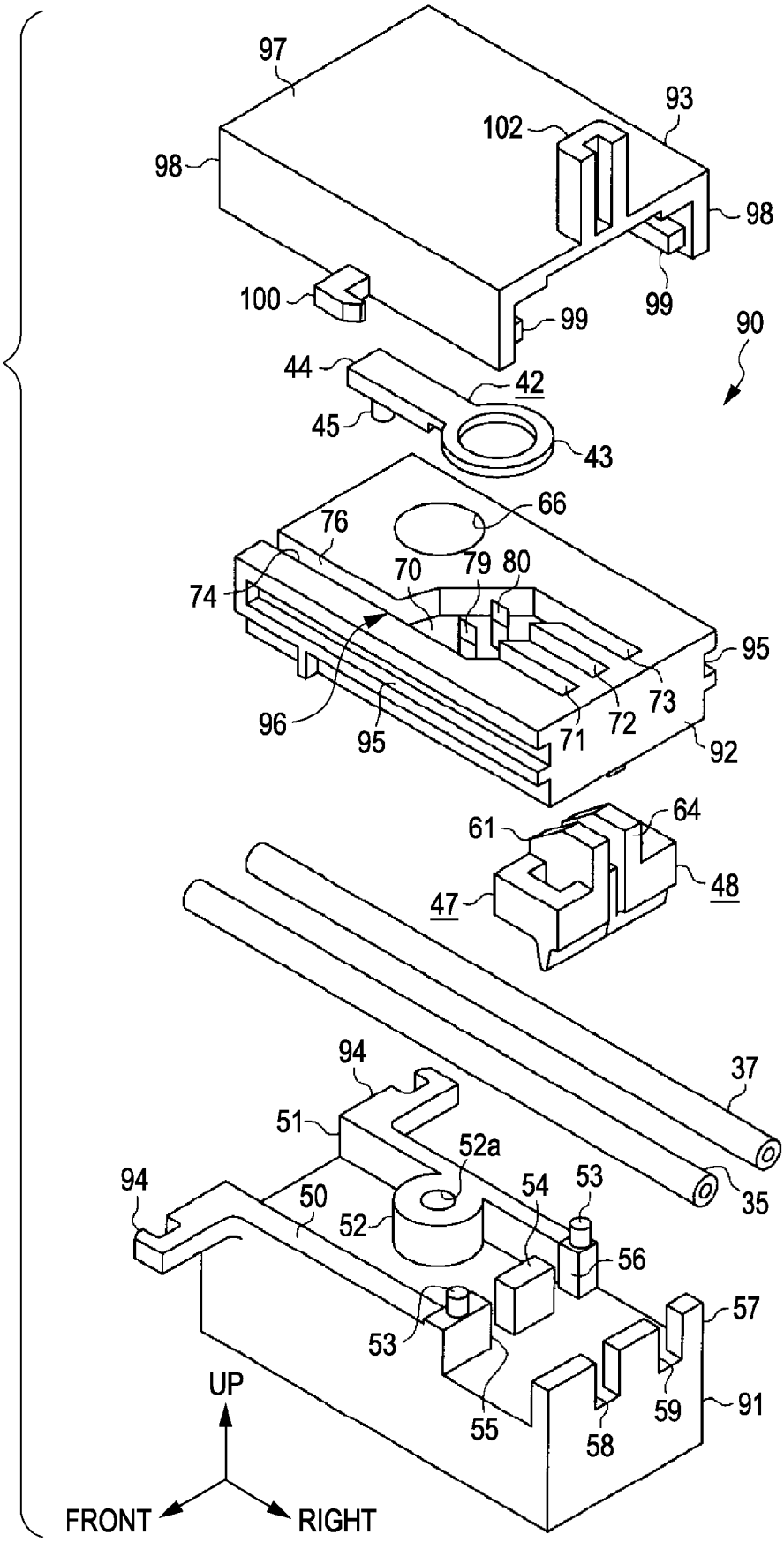
FIG. 11 is an exploded perspective view of FIG. 10.

In the second embodiment, as illustrated in FIGS. 10 and 11, the valve unit 40 of the first embodiment is changed to a valve unit 90. Specifically, the valve unit 90 includes a case member 91, both the pressing members 47 and 48, a cover member 92, the swing member 42, and a slider 93 for covering the upper surface of the cover member 92. Therefore, in the second embodiment, the swing member 42 is not supported by the lower surface of the carriage 16, and the convex portion 41 of the carriage 16 is omitted.

Figure 12:
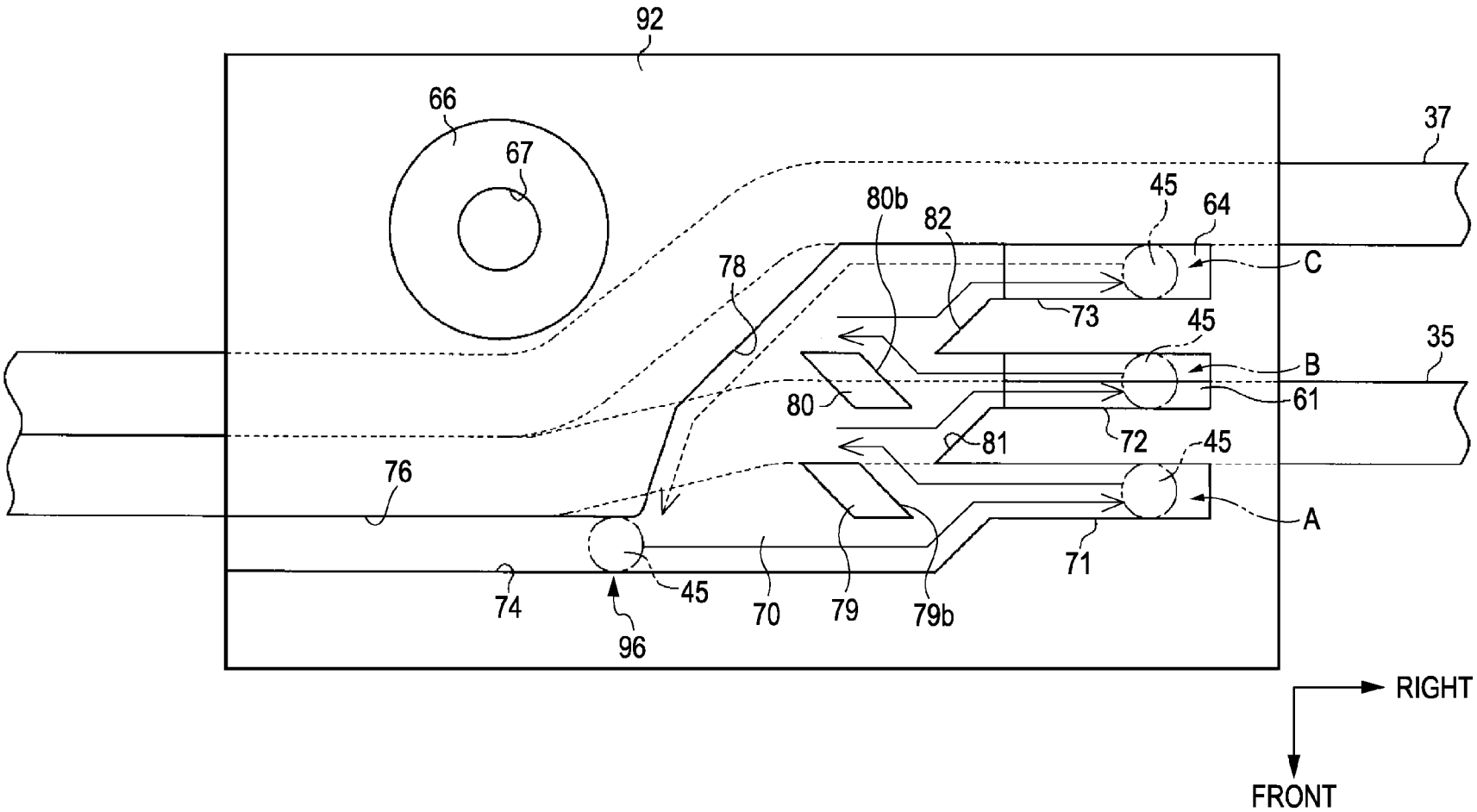
FIG. 12 is a plan view illustrating a cover member of the valve unit.

As illustrated in FIGS. 10 to 12, the case member 91 is configured by allowing a pair of hook portions 94 to extend outward (in the front and rear direction) from the upper end portions of the left end portions of both the front and rear side surfaces of the case member 46 of the first embodiment. The cover member 92 is configured by providing sliding grooves 95 extending in the left and right direction for both the front and rear side surfaces of the cover member 49 of the first embodiment, and allowing the rear side surface 76 on the left from the constricted portion 77 in the groove 70 to extend in parallel with the front side surface 74 at an interval that is slightly greater than the outside diameter of the pin portion 45. In this case, the cover member 92 has a standby position 96 for the pin portion 45 at a position corresponding to the constricted portion 77 of the groove 70 of the cover member 49 of the first embodiment. In addition, both the sliding grooves 95 of the cover member 92 have left end sides that are blocked and right end sides that are open.

The slider 93 includes a top plate 97 having a rectangular plate shape, and a pair of slide plates 98 having a rectangular plate shape and straightly extending downward from the front and rear edge portions of the lower surface of the top plate 97. The inner surfaces of both the side plates 98 are provided with a pair of sliding convex strips 99 extending in the left and right direction. Both the sliding convex strips 99 are inserted into both the sliding grooves 95 of the cover member 92 and able to slide in the left and right direction along both the sliding grooves 95.

The lower end portions at the centers of the outer surfaces of both the side plates 98 are provided with a pair of protruding locking pieces 100 each of which has a tip end portion bent to the right. Both the locking pieces 100 are connected to the hook portions 94 of the case member 91 via coil springs 101 interposed therebetween. Both the coil springs 101 always bias the slider 93 via the locking pieces 100 to the left. Therefore, normally, by the biasing force of both the coil springs 101, the slider 93 is in a standby state in which the left surfaces of both the sliding convex strips 99 are in contact with the left surfaces of both the sliding grooves 95.

The lower surface of the top plate 97 is provided with a convex portion (not shown), and the swing member 42 is swingably supported by the convex portion. In addition, in the standby state of the slider 93, the pin portion 45 of the swing member 42 slidably inserted into the groove 70 of the cover member 92 is at the standby position 96. In addition, on the right end portion of the upper surface of the top plate 97 at the center in the front and rear direction, an engagement column 102 stands which can be engaged with the carriage 16.

Figure 13:
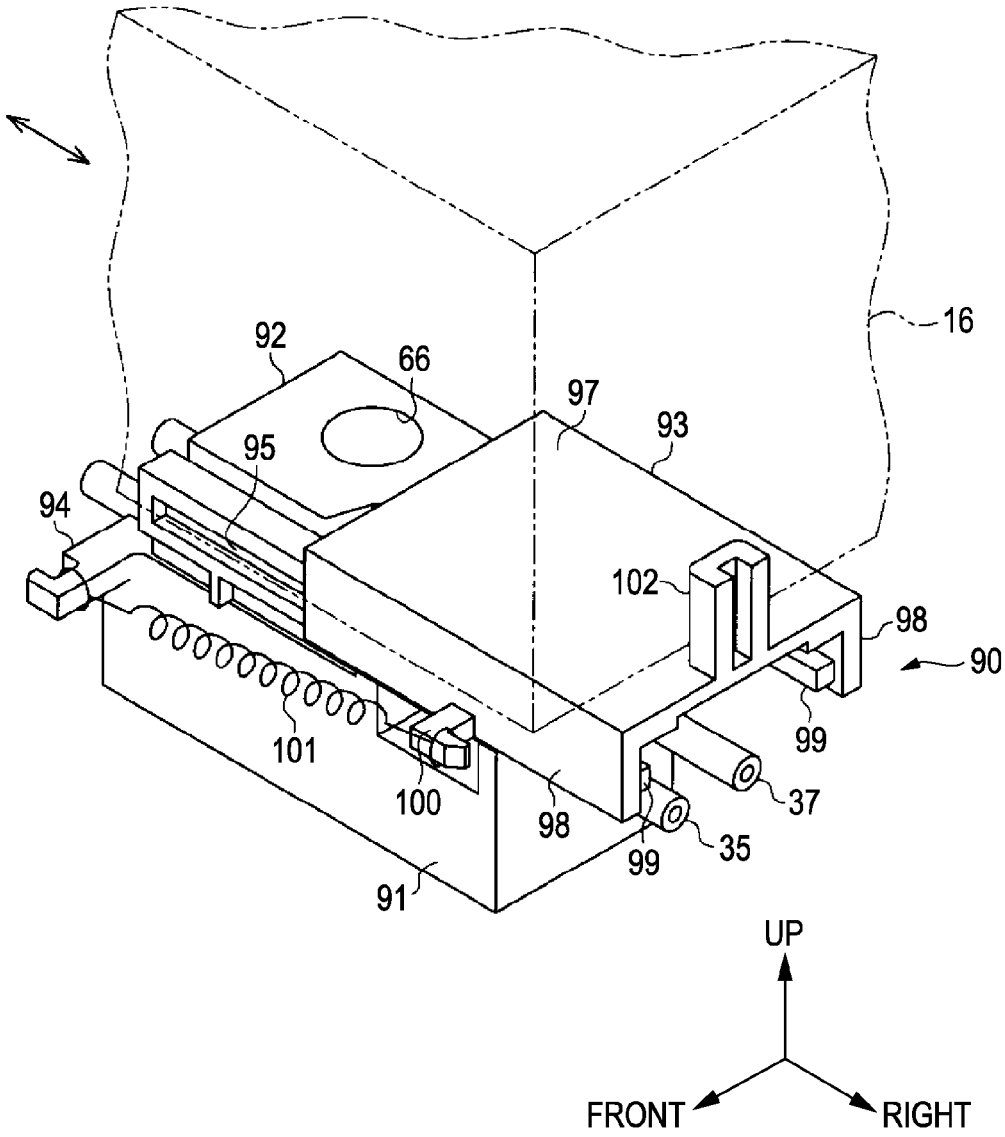
FIG. 13 is a perspective view illustrating a state where a slider of the valve unit is slid to the right by the carriage.

However, as illustrated in FIGS. 12 and 13, when the carriage 16 is moved to the home position, the right surface of the carriage 16 comes in contact with the left surface of the engagement column 102, and in the state where the carriage 16 is moved to the home position, the carriage 16 presses the engagement column 102 to the right. Thus, the slider 93 slides to the right along with the carriage 16 against the biasing force of both the coil springs 101. Here, the pin portion 45 of the swing member 42 is disposed at the non-blocking position A.

In addition, in the maintenance area MA, when the carriage 16 is reciprocated in the left and right direction from the home position as a starting point, by the operation of both the spring coils 101, the slider 93 is reciprocated in the left and right direction along the reciprocating movement of the carriage 16. By the reciprocating movement of the slider 93 and the operations of the cam surface 79*b*, 81, 80*b*, and 82, the swing member 42 is swung, and the pin portion 45 of the swing member 42 is led from the non-blocking position A to the blocking position B and from the blocking position B to the blocking position C in this order, for switching between the blocking states of both the discharge tubes 35 and 37.

According to the second embodiment described above, in addition to the effects of (1) to (4) described above, the following effects can be obtained.

(5) Since the swing member 42 is assembled inside the valve unit 90, the swing member 42 is hidden by the slider 93 and cannot be seen from the outside. Therefore, the outer appearance quality of the ink jet printer 11 can be improved. Further, the inks are not likely to be adhered to the swing member 42, so that swing movement failure of the swing member 42 can be reduced.

(6) Since the swing member 42 is not supported by the carriage 16, the weight on the carriage 16 is reduced by the swing member 42 as compared with the first embodiment. Accordingly, the load exerted on the carriage motor 18 to drive the carriage 16 can be reduced.

Third Embodiment

Hereinafter, a third embodiment of the invention will be described mainly regarding the differences thereof from the first embodiment.

Figure 14:
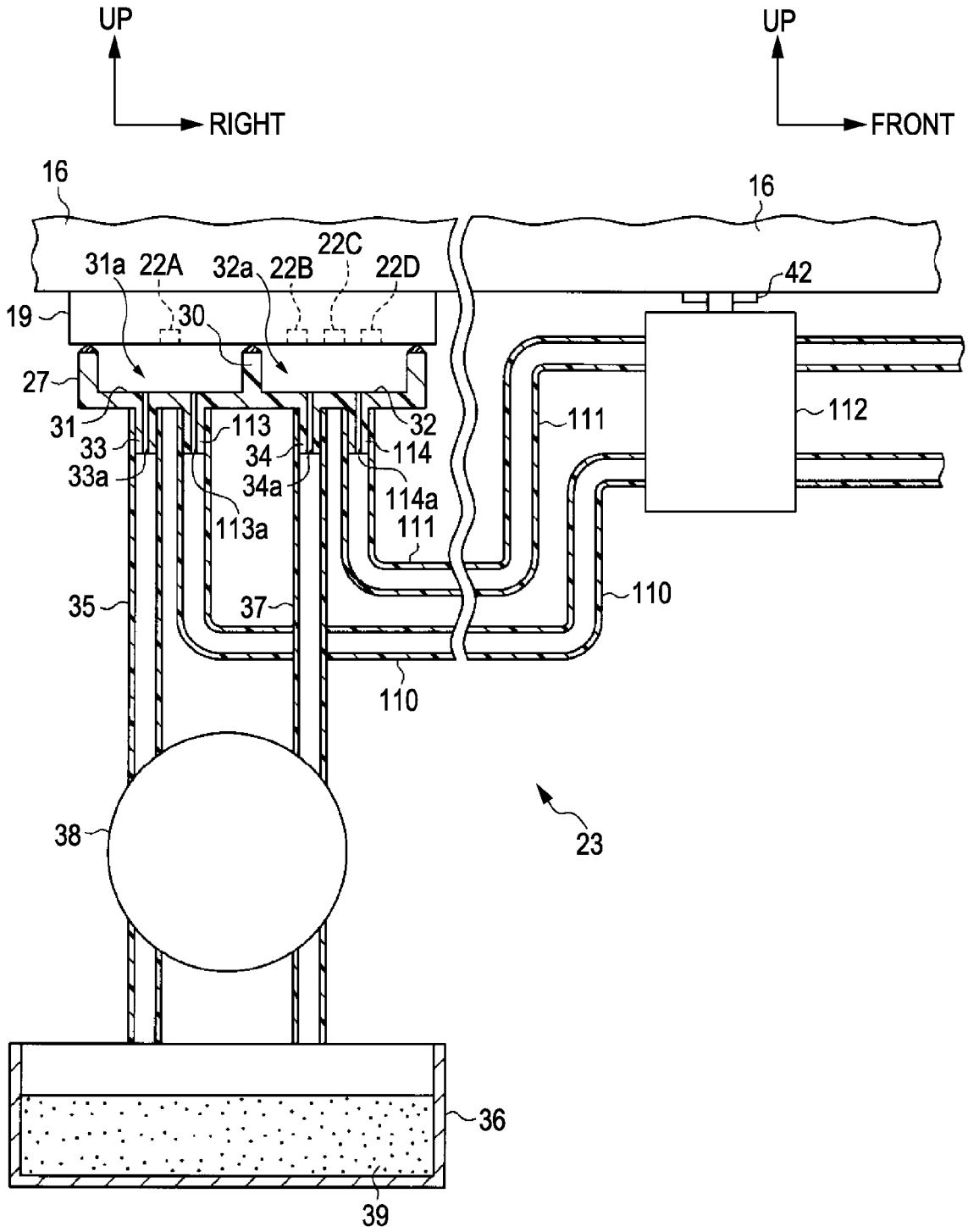
FIG. 14 is a cross-sectional view schematically illustrating a maintenance mechanism according to a third embodiment.

In the third embodiment, as illustrated in FIG. 14, first and second atmosphere opening tubes 110 and 111 for allowing the first and second cap internal spaces 31*a* and 32*a* to be open to the atmosphere are connected to the first and second cap portions 31 and 32 of the cap 27 of the first embodiment, and a valve unit 112 is provided in the middle of the first and second atmosphere opening tubes to selectively block them instead of the valve unit 40. Therefore, the first and second discharge tubes 35 and 37 are not provided with the blocking valve unit 40.

Specifically, as illustrated in FIG. 14, a third protruding portion 113 protrudes downward from the bottom wall of the first cap portion 31 to correspond to the first protruding portion 33, and a first communication passage 113*a* which communicates with the inside and the outside of the first cap portion 31 penetrates through the third protruding portion 113 in the up and down direction. In addition, a fourth protruding portion 114 protrudes downward from the bottom wall of the second cap portion 32 to correspond to the second protruding portion 34, and a second communication passage 114*a* which communicates with the inside and the outside of the second cap portion 32 penetrates through the fourth protruding portion 114 in the up and down direction.

A base end side (upstream side) of the first atmosphere opening tube 110 having flexibility as an atmosphere opening passage is connected to the third protruding portion 113, and the other end side (downstream side) of the first atmosphere opening tube 110 is left in a state open to the atmosphere in the frame 12. In addition, a base end side (upstream side) of the second atmosphere opening tube 111 having flexibility as an atmosphere opening passage is connected to the fourth protruding portion 114, and the other end side (downstream side) of the second atmosphere opening tube 111 is left in a state open to the atmosphere in the frame 12.

Therefore, the first cap internal space 31*a* communicates with the atmosphere via the first communication passage 113*a* and the first atmosphere opening tube 110, and the second cap internal space 32*a* communicates with the atmosphere via the second communication passage 114*a* and the second atmosphere opening tube 111. In addition, in this embodiment, the first and second discharge tubes 35 and 37 are not joined to each other for confluence, and the insides of both the discharge tubes 35 and 37 are simultaneously sucked by the single tube pump 38 from the cap 27 toward the waste ink tank 36.

Next, the configuration of the valve unit 112 will be described in detail.

Figure 15:
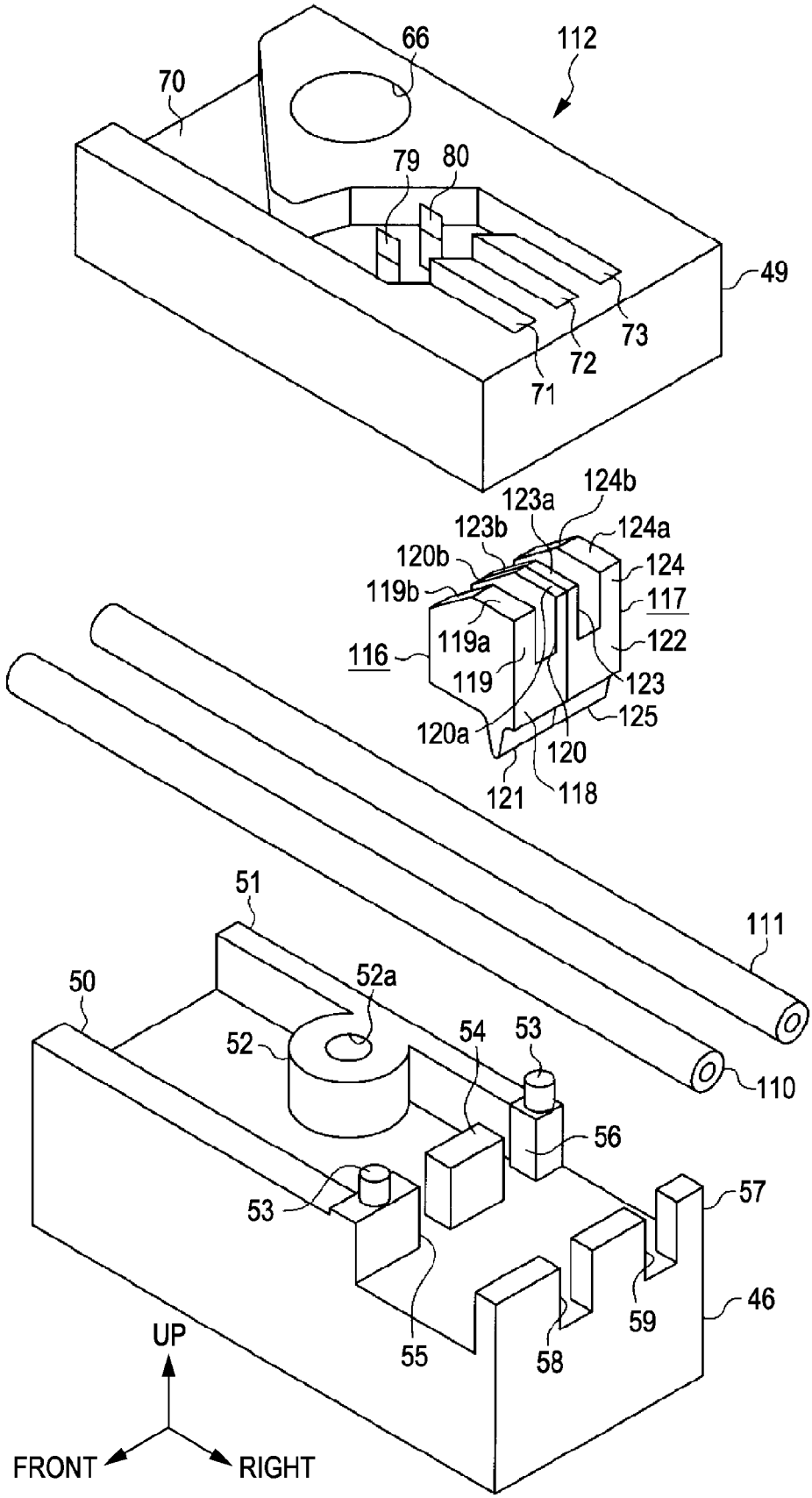
FIG. 15 is an exploded perspective view illustrating a valve unit according to a third embodiment.
Figure 16:
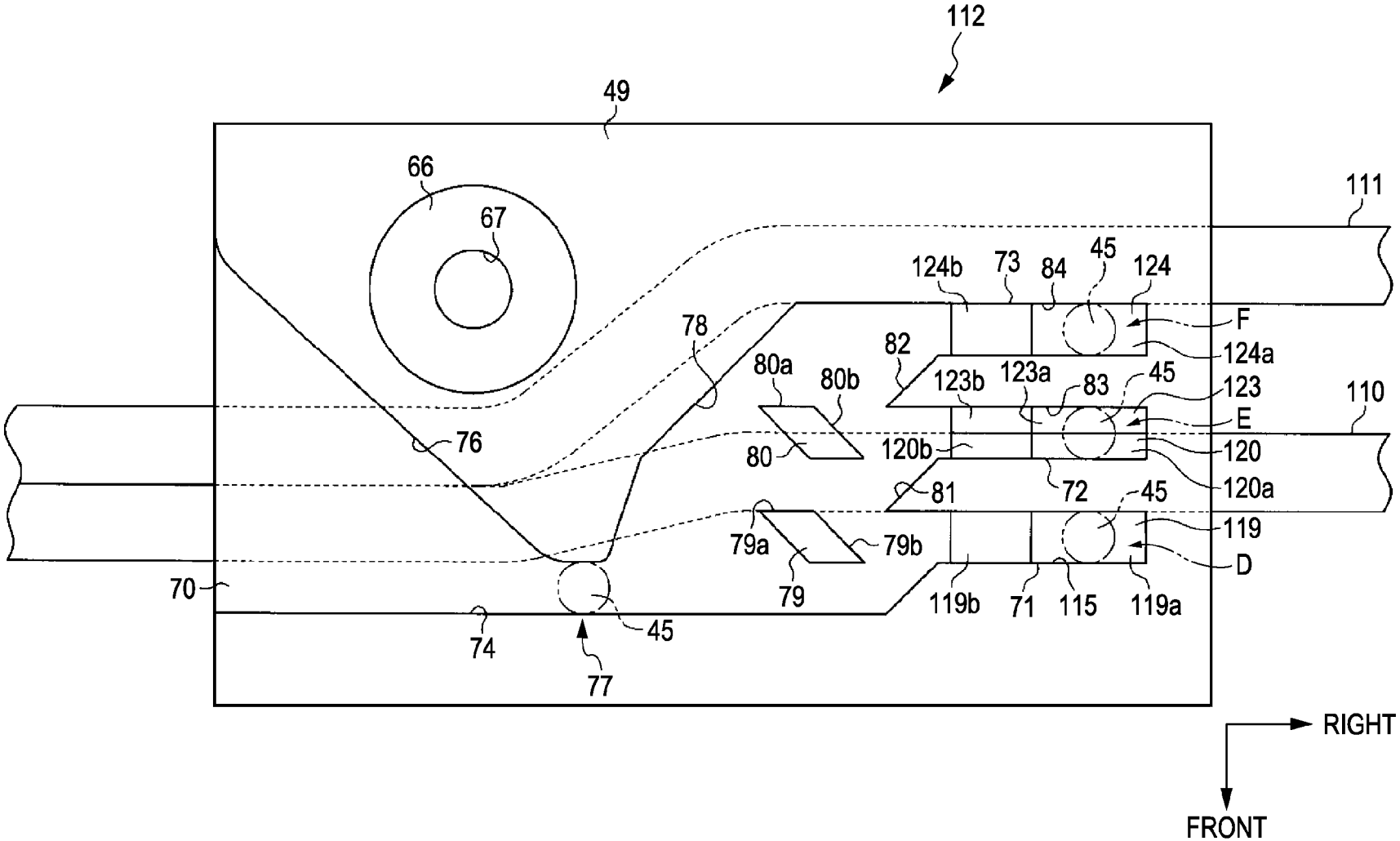
FIG. 16 is a plan view illustrating the valve unit according to the third embodiment.

As illustrated in FIGS. 15 and 16, the valve unit 112 is configured such that almost the entire portion of the bottom wall of the dead end portion 71 of the valve unit 40 of the first embodiment is provided with an insertion hole 115 penetrating the cover member 49 in the up and down direction, and the first and second pressing members 47 and 48 are changed to third and fourth pressing members 116 and 117. In addition, in the valve unit 112, the first and second atmosphere opening tubes 110 and 111 are drawn to extend.

The third pressing member 116 has a main body portion 118 with a block shape, and first and second projecting portions 119 and 220 having a plate shape stand on the front and rear edge portions of the upper surface of the main body portion 118. An upper surface 119*a* of the first projecting portion 119 is horizontal, and an inclined surface 119*b* is formed adjacent to the upper surface 119*a* on the left from the upper surface 119*a*. The inclined surface 119*b* is inclined upwardly toward the upper surface 119*a*.

The second projecting portion 120 has a thickness that is the half the thickness of the first projecting portion 119, and the shape thereof in the left and right direction is the same as that of the first projecting portion 119. Therefore, the upper surface 120*a* of the second projecting portion 120 is horizontal, and an inclined surface 120*b* is formed adjacent to the upper surface 120*a* on the left from the upper surface 120*a*. The inclined surface 120*b* is inclined upwardly toward the upper surface 120*a*.

The right end portion of the lower surface of the main body portion 118 is provided with a convex strip 121 protruding downward and extending in the front and rear direction. With regard to the convex strip 121, the width in the left and right direction gradually decreases toward the tip end portion (lower end portion), and the tip end (lower end) is circular. In addition, the tip end of the convex strip 121 comes in contact with the upper surface of the first atmosphere opening tube 110 between the gap 55 and the cut-off recessed portion 58 in the case member 46.

In addition, the fourth pressing member 117 has a main body portion 122 with a block shape, and third and fourth projecting portions 123 and 124 having a plate shape stand on the front and rear edge portions of the upper surface of the main body portion 122. The third projecting portion 123 has the same shape as the second projecting portion 120, and the fourth projecting portion 124 has the same shape as the first projecting portion 119.

An upper surface 123*a* of the third projecting portion 123 is horizontal, and an inclined surface 123*b* is formed adjacent to the upper surface 123*a* on the left from the upper surface 123*a*. The inclined surface 123*b* is inclined upwardly toward the upper surface 123*a*. An upper surface 124*a* of the fourth projecting portion 124 is horizontal, and an inclined surface 124*b* is formed adjacent to the upper surface 124*a* on the left from the upper surface 124*a*. The inclined surface 124*b* is inclined upwardly toward the upper surface 124*a*.

The right end portion of the lower surface of the main body portion 122 is provided with a convex strip 125 protruding downward and extending in the front and rear direction. With regard to the convex strip 125, the width in the left and right direction gradually decreases toward the tip end portion (lower end portion), and the tip end (lower end) is circular. In addition, the tip end of the convex strip 125 comes in contact with the upper surface of the second atmosphere opening tube 111 between the gap 56 and the cut-off recessed portion 59 in the case member 46.

In addition, the third and fourth pressing members 116 and 117 have shapes that are symmetrical with respect to the vertical plane stretching in the up and down direction and the left and right direction as a symmetry plane.

As illustrated in FIGS. 15 and 16, the first projecting portion 119 of the third pressing member 116 is inserted into the insertion hole 115 of the dead end portion 71 from below. In this case, the upper surface 119*a* of the first projecting portion 119 is at a height slightly lower than the upper surface of the cover member 49. The second projecting portion 120 of the third pressing member 116 and the third projecting portion 123 of the fourth pressing member 117 are inserted into the insertion hole 83 of the dead end portion 72 from below while being aligned with each other. In this case, the upper surface 120*a* of the second projecting portion 120 and the upper surface 123*a* of the third projecting portion 123 are at heights slightly lower than the upper surface of the cover member 49.

The fourth projecting portion 124 of the fourth pressing member 117 is inserted into the insertion hole 84 of the dead end portion 73 from below. In this case, the upper surface 124*a* of the fourth projecting portion 124 is at a height slightly lower than the upper surface of the cover member 49.

In addition, in the case where the carriage 16 is moved to the home position, when the pin portion 45 of the swing member 42 is in the dead end portion 71, the position of the pin portion 45 is referred to as a blocking position D, when the pin portion is in the dead end portion 72, the position of the pin portion 45 is referred to as a blocking position E, and when the pin portion 45 is in the dead end portion 73, the position of the pin portion 45 is referred to as a blocking position F.

Therefore, when the pin portion 45 of the swing member 42 is at the blocking position D, the pin portion 45 of the swing member 42 presses and crushes the first atmosphere opening tube 110 with the third pressing member 116 interposed therebetween, thereby blocking the first atmosphere opening tube 110. In addition, when the pin portion 45 of the swing member 42 is at the blocking position E, the pin portion 45 presses and crushes the first and second atmosphere opening tubes 110 and 111 with the third and fourth pressing members 116 and 117 interposed therebetween, thereby blocking both the first and second atmosphere opening tubes 110 and 111.

Additionally when the pin portion 45 of the swing member 42 is at the blocking position F, the pin portion 45 presses and crushes the second atmosphere opening tube 111 with the fourth pressing member 117 interposed therebetween, thereby blocking the second atmosphere opening tube 111.

Next, the operation of the ink jet printer 11 during cleaning will be described.

Entire Cleaning

However, in the case where cleaning of the entire print head 19 for sucking inks from the nozzles 22 of the entire nozzle rows 22A to 22D is performed, first, the carriage 16 is moved to the home position in the maintenance area MA. Then, the cap 27 comes in contact with the print head 19, the first cap portion 31 forms the first cap internal space 31*a* with the print head 19 while enclosing the nozzle row 22A, and at the same time, the second cap portion 32 forms the second cap internal space 32*a* with the print head 19 while enclosing the nozzle rows 22B to 22D.

Thereafter, the carriage 16 is reciprocated from the home position so as to move the pin portion 45 of the swing member 42 to the blocking position E in the dead end portion 72. Then, the pin portion 45 presses and crushes the first and second atmosphere opening tubes 110 and 111 with the third and fourth pressing members 116 and 117 interposed therebetween, so that the insides of the first and second atmosphere opening tubes 110 and 111 are in the blocked states.

When the tube pump 38 is operated in this state, the insides of both the atmosphere opening tubes 110 and 111 are simultaneously sucked, and negative pressures occur in the first and second cap internal spaces 31*a* and 32*a*. Due to the negative pressures, the black inks that have thickened are sucked from each nozzle 22 of the nozzle row 22A along with air bubbles, and discharged into the waste ink tank 36 via the first cap portion 31 and the first discharge tube 35. At the same time, the cyan ink, the yellow ink, and the magenta ink that have thickened are sucked from the nozzles 22 of the nozzle rows 22B to 22D along with air bubbles and discharged into the waste ink tank 36 via the second cap portion 32 and the second discharge tube 37. By this operation, the entire cleaning procedure for sucking the inks from each nozzle 22 of the entire nozzle rows 22A to 22D of the print head 19 is completed.

Selective Cleaning

In the case where selective cleaning of the print head 19 for sucking inks (color inks) from the nozzles 22 of the nozzle rows 22B to 22D from among all of the nozzle rows 22A to 22D is performed, the carriage 16 is moved to the home position to move the pin portion 45 of the swing member 42 to the blocking position D in the dead end portion 71. Then, the pin portion 45 presses and crushes the first atmosphere opening tube 110 with the third pressing member 116 interposed therebetween, so that the inside of the first atmosphere opening tube 110 is in the blocked state. Here, the second atmosphere opening tube 111 is not blocked.

When the tube pump 38 is operated in this state, the insides of both the discharge tubes 35 and 37 are simultaneously sucked. However, since the first atmosphere opening tube 110 is blocked by the third pressing member 116 and the second atmosphere opening tube 111 is not blocked, negative pressure occurs only in the second cap internal space 32*a* from among both the cap internal spaces 31*a* and 32*a*. Here, negative pressure slightly occurs in the first cap internal space 31*a*, however, this negative pressure is not enough to affect the meniscus of each nozzle 22 of the nozzle row 22A.

In addition, due to the negative pressure in the second cap internal space 32*a*, the cyan ink, the yellow ink, and the magenta ink that have thickened are sucked from the nozzles 22 of the nozzle rows 22B to 22D along with air bubbles and discharged into the waste ink tank 36 via the second cap portion 32 and the second discharge tube 37. By the operation, the selective cleaning of the print head 19 for sucking the inks (color inks) from the nozzles 22 of the nozzle rows 22B to 22D from among all of the nozzle rows 22A to 22D is completed.

In addition, in the case where selective cleaning of the print head 19 for sucking the black inks from each nozzle 22 of the nozzle row 22A from among all of the nozzle rows 22A to 22D is performed, after the carriage 16 is moved to the home position, it is reciprocated twice from the home position to move the pin portion 45 of the swing member 42 to the blocking position F in the dead end portion 73. Then, the pin portion 45 presses and crushes the second atmosphere opening tube 111 with the fourth pressing member 117 interposed therebetween, so that the inside of the second atmosphere opening tube 111 is in the blocked state. Here, the first atmosphere opening tube 110 is not blocked.

When the tube pump 38 is operated in this state, the insides of both the discharge tubes 35 and 37 are simultaneously sucked. However, since the second atmosphere opening tube 111 is blocked by the fourth pressing member 117 and the first atmosphere opening tube 110 is not blocked, negative pressure occurs only in the first cap internal space 31*a* from among both the cap internal spaces 31*a* and 32*a*. Here, negative pressure slightly occurs in the second cap internal space 32*a*, however, this negative pressure is not enough to affect the meniscus of each nozzle 22 of the nozzle rows 22B to 22D.

In addition, due to the negative pressure in the first cap internal space 31*a*, the black inks that have thickened are sucked from the nozzles 22 of the nozzle row 22A along with air bubbles and discharged into the waste ink tank 36 via the first cap portion 31 and the first discharge tube 35. By this operation, the selective cleaning of the print head 19 for sucking the black inks from the nozzles 22 of the nozzle row 22A from among all of the nozzle rows 22A to 22D is completed.

According to the third embodiment described above, the following effects can be obtained.

(7) In the maintenance area MA, as the carriage 16 is reciprocated in the left and right direction from the home position as the starting point, the pin portion 45 of the swing member 42 is led from the blocking position D to the blocking position E and from the blocking position E to the blocking position F in this order by the operations of the cam surfaces 79*b*, 81, 80*b*, and 82 in the direction perpendicular to the movement direction of the carriage 16 and the direction in which the cap 27 comes in contact with the print head 19. Specifically, the blocked states of both the atmosphere opening tubes 110 and 111 can be easily switched simply by reciprocating the carriage 16 in the left and right direction in the existing maintenance area. Therefore, without expanding the movement range of the carriage 16, the insides of both the atmosphere opening tubes 110 and 111 can be selectively blocked, so that both the cap internal spaces 31*a* and 32*a* can be selectively sealed. As a result, by simultaneously sucking both the cap internal spaces 31*a* and 32*a* using the tube pump 38, negative pressures in the cap internal spaces 31*a* and 32*a* can be selectively generated. Therefore, without increasing the size of the ink jet printer 11, selective cleaning between the black ink and the color inks can be performed.

Fourth Embodiment

Hereinafter, a fourth embodiment of the invention will be described mainly regarding differences thereof from the first embodiment.

Figure 17:
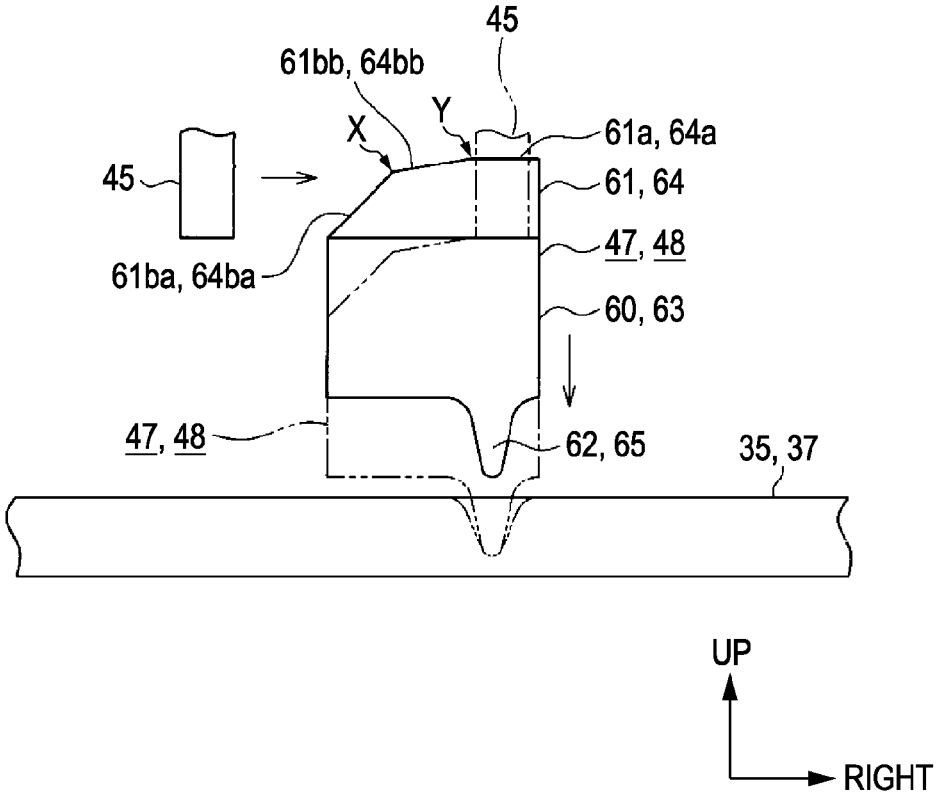
FIG. 17 is a side view illustrating first and second pressing members according to a fourth embodiment.

In the fourth embodiment, as illustrated in FIG. 17, the valve unit 40 of the first embodiment is changed so that the inclined surface 61*b* of the projecting portion 61 of the first pressing member 47 is changed to two inclined surfaces 61*ba* and 61*bb* which have different tilt angles, and the inclined surface 64*b* of the projecting portion 64 of the second pressing member 48 is changed to two inclined surfaces 64*ba* and 64*bb* which have different tilt angles.

As illustrated in FIG. 17, the inclined surfaces 61*ba*, 61*bb*, 64*ba*, and 64*bb* are inclined upwardly to the left and configured as sliding surfaces. The inclined surfaces 61*ba* and 64*ba* have the same tilt angle with respect to the horizontal plane, and the inclined surfaces 61*bb* and 64*bb* have the same tilt angle with respect to the horizontal plane. The inclined surfaces 61*ba* and 64*ba* are adjacent to the left sides of the respective inclined surfaces 61*bb* and 64*bb*, and of which the tilt angles with respect to the horizontal plane are greater than those of the inclined surfaces 61*bb* and 64*bb*. In this embodiment, the tilt angles of the inclined surfaces 61*ba* and 64*ba* with respect to the horizontal plane are set to 45 degrees, and the tilt angles of the inclined surfaces 61*bb* and 64*bb* with respect to the horizontal plane are set to 10 degrees.

Figure 18A:
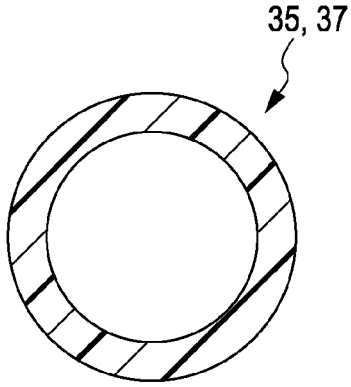
FIGS. 18A to 18D are cross-sectional views illustrating states where first and second discharge tubes are crushed according to fourth and fifth embodiments.
Figure 18B:
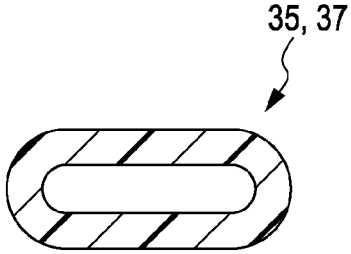

In the case where the suction passage (space) inside the first discharge tube 35 is to be blocked, the carriage 16 is reciprocated, and the pin portion 45 is moved to the blocking position B in the dead end portion 72. Then, as illustrated in FIG. 17, the pin portion 45 slides across the inclined surface 61*ba* of the projecting portion 61 of the first pressing member 47 from the left to the right, and due to the sliding, the first pressing member 47 is pressed down. Correspondingly, the first discharge tube 35 is pressed by the first pressing member 47, so that the cross-section thereof is changed from a substantially circular shape as illustrated in FIG. 18A to a substantially elliptical shape as illustrated in FIG. 18B.

Figure 18C:
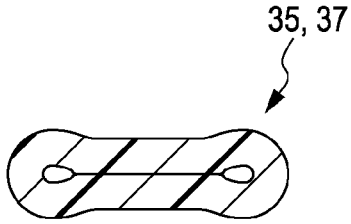

Next, the pin portion 45 slides across the inclined surface 61*ba* from the left to the right, and when the pin portion 45 reaches a border X between the inclined surfaces 61*ba* and 61*bb*, the first discharge tube 35 is additionally pressed by the first pressing member 47 such that the suction passage inside the first discharge tube 35 is crushed to be almost blocked as illustrated in FIG. 18C. Then, when the pin portion 45 slides across the inclined surface 61*bb* over the border X from the left to the right, due to the sliding, the first pressing member 47 is additionally pressed down.

Figure 18D:
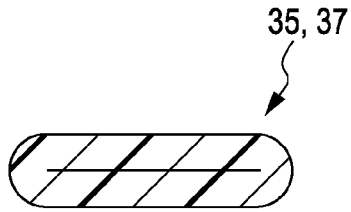

Correspondingly, the first discharge tube 35 is additionally pressed by the first pressing member 47, so that the suction passage inside the first discharge tube 35 is crushed to be completely blocked as illustrated in FIG. 18D. Next, the pin portion 45 slides across the inclined surface 61*bb* from the left to the right. Here, until the pin portion 45 reaches a border Y between the inclined surface 61*bb* and the upper surface 61*a*, the first pressing member 47 is continuously pressed down.

Therefore, the first discharge tube 35 is additionally pressed by the first pressing member 47 after the suction passage inside the first discharge tube 35 is completely blocked.

Here, as in the first embodiment, in the case where the pin portion 45 slides across the single inclined one surface 61*b* of which the tilt angle with respect to the horizontal plane is constant and reaches the upper surface 61*a*, the pressing degree at which the first discharge tube 35 is pressed by the first pressing member 47 is continuous. In addition, the reaction force of the first discharge tube 35 that occurs when the first discharge tube 35 is crushed by the first pressing member 47 becomes greater after the suction passage inside the first discharge tube 35 is blocked than before the suction passage inside the first discharge tube 35 is blocked. This is because until the suction passage inside the first discharge tube 35 is blocked, the suction passage (internal space) of the first discharge tube 35 has been crushed, and after the suction passage inside the first discharge tube 35 is blocked, the first discharge tube 35 itself (the material of the first discharge tube 35) is crushed.

Therefore, after the suction passage inside the first discharge tube 35 is blocked, high reaction force is exerted on the first pressing member 47 from the first discharge tube 35, so that loads (loads on the carriage motor 18) on the pin portion 45 and the carriage 16 during the movement in the left and right direction increase. Therefore, there is a concern that the durability of the components will be degraded.

In this aspect, according to this embodiment, the inclined surface 61*bb* is gentler than the inclined surface 61*ba*, so that the downward movement degree of the first pressing member 47 when the pin portion 45 slides across the inclined surface 61*bb* is smaller than that of the first pressing member 47 when the pin portion 45 slides across the inclined surface 61*ba*. That is, the degree at which the first discharge tube 35 is pressed by the first pressing member 47 after the suction passage inside the first discharge tube 35 is blocked is smaller than that until the suction passage inside the first discharge tube 35 is blocked.

As a result, after the suction passage inside the first discharge tube 35 is blocked, the reaction force exerted on the first pressing member 47 from the first discharge tube 35 is reduced, so that the loads (load on the carriage motor 18) on the pin portion 45 and the carriage 16 during the movement in the left and right direction can be suppressed, thereby enhancing the durability of the components.

In addition, when the pin portion 45 is moved to the blocking position B, the pin portion 45 is in the state (the state shown by dot-dot-dashed lines of FIG. 17) of being completely placed on the upper surface 61*a* of the projecting portion 61 of the first pressing member 47. In this state, since the pin portion 45 presses down the first pressing member 47 reliably, the convex strip 62 of the first pressing member 47 completely crushes the first discharge tube 35 to completely block the suction passage inside the first discharge tube 35.

In addition, the operation of the second pressing member 48 for crushing the second discharge tube 37 is the same as the operation of the first pressing member 47 for crushing the first discharge tube 35, so detailed description thereof will be omitted.

According to the fourth embodiment described above, in addition to the effects of (1) to (4), the following effects can be obtained.

(8) Since the inclined surface 61*bb* is gentler than the inclined surface 61*ba*, the downward movement degree of the first pressing member 47 that occurs when the pin portion 45 slides across the inclined surface 61*bb* is smaller than the downward movement degree of the first pressing member 47 that occurs when the pin portion 45 slides across the inclined surface 61*ba*. That is, the degree at which the first discharge tube 35 is pressed by the first pressing member 47 after the suction passage inside the first discharge tube 35 is blocked is smaller than the degree at which the first discharge tube 35 has been pressed by the first pressing member 47 until the suction passage of the first discharge tube 35 is blocked. As a result, after the suction passage of the first discharge tube 35 is blocked, the reaction force exerted on the first pressing member 47 from the first discharge tube 35 is reduced, so that the loads (load on the carriage motor 18) on the pin portion 45 and the carriage 16 during the movement in the left and right direction can be suppressed, thereby enhancing the durability of the components.

Fifth Embodiment

Hereinafter, a fifth embodiment of the invention will be described mainly regarding differences thereof from the first embodiment.

Figure 19:
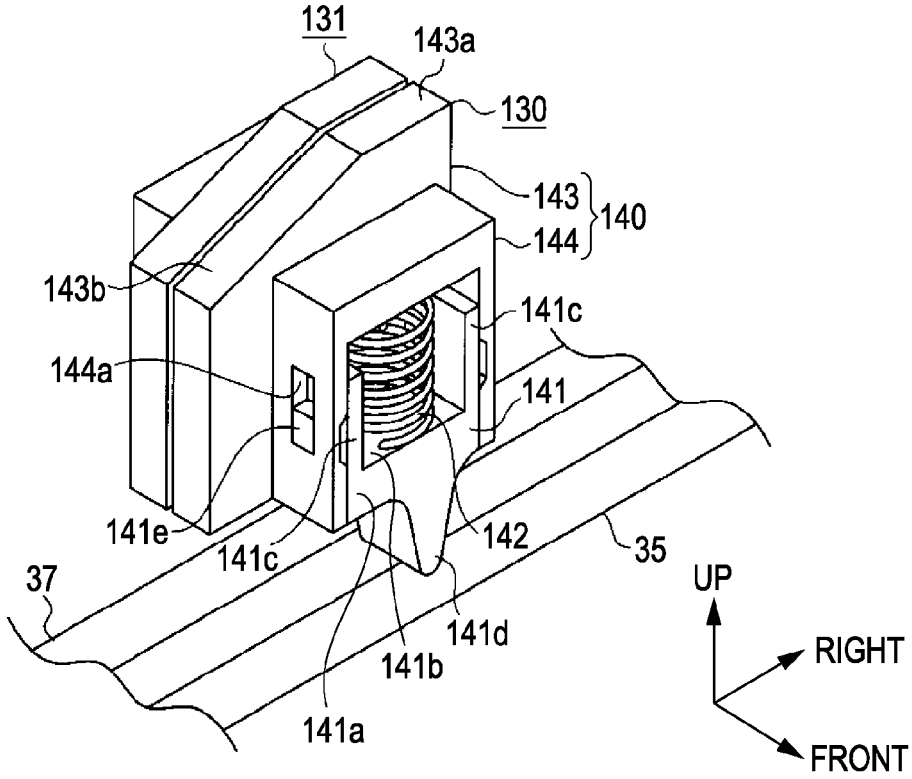
FIG. 19 is a perspective view illustrating first and second pressing units according to the fifth embodiment.

In the fifth embodiment, as illustrated in FIG. 19, the first and second pressing members 47 and 48 of the valve unit 40 of the first embodiment are changed to first and second pressing units 130 and 131 as a pressing unit. In addition, the first and second pressing units 130 and 131 are symmetrical with respect to a plane parallel with the up and down direction and the left and right direction, and the other configurations and effects thereof are completely the same. Therefore, only the case of the first pressing unit 130 will be described, and the description of the second pressing unit 131 will be omitted.

Figure 20:
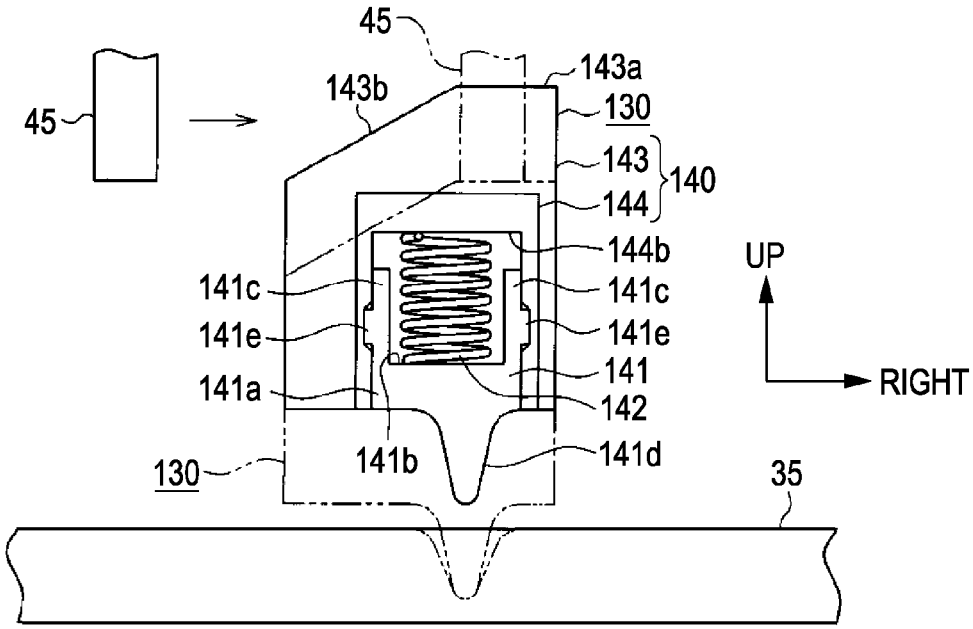
FIG. 20 is a side view illustrating the first pressing unit according to the fifth embodiment.

As illustrated in FIGS. 19 and 20, the first pressing unit 130 includes a base member 140 as a first member, a push member 141 as a second member, and a compression spring 142 stored and maintained between the base member 140 and the push member 141. The base member 140 includes a sliding plate 143 which is parallel in the up and down direction and the left and right direction and an accommodation portion 144 which is provided on the front surface of the sliding plate 143 and has a rectangular box shape in which the front side and the lower side are open.

An upper surface 143*a* of the sliding plate 143 is horizontal, and an inclined surface 143*b* is formed adjacent to the upper surface 143*a* on the left from the upper surface 143*a*. The inclined surface 143*b* is inclined upwardly toward the upper surface 143*a*. The left and right walls of the accommodation portion 144 are provided with long holes 144*a* in the up and down direction to penetrate through the left and right walls. In the accommodation portion 144, the push member 141 is accommodated to slide inside the accommodation portion 144 in the up and down direction.

The push member 141 includes a main body portion 141*a* having a block shape, a pair of standing portions 141*c* with a rectangular plate shape which stand on the left and right end portions of an upper surface 141*b* of the main body portion 141*a*, and a convex strip 141*d* which protrudes downward from the lower surface of the main body portion 141*a* at a position close to the right and extends in the front and rear direction. The convex strip 141*d* protrudes outward from the accommodation portion 144 from the opening of the lower side of the accommodation portion 144 and the circular lower end thereof comes in contact with the first discharge tube 35.

The outer sides of both the standing portions 141*c* in the front and right direction are provided with protrusions 141*e*, and the protrusions 141*e* are slidably inserted into the long holes 144*a* provided in the left and right walls of the accommodation portion 144. In this case, the tip end surfaces of both the protrusions 141*e* are flush with the outer surfaces of the left and right walls of the accommodation portion 144. Between an inner surface 144*b* of the upper wall of the accommodation portion 144 and an upper surface 141*b* of the main body portion 141*a* of the push member 141, the compression spring 142 having a coil shape is interposed for biasing the upper surface 141*b* and the inner surface 144*b* in a direction to be separated from each other.

The compression spring 142 is stored between the upper surface 141*b* and the inner surface 144*b* in a state (slightly compressed state) in which it generates a pressing load needed to allow the push member 141 to crush the first discharge tube 35 until the suction passage (space) of the first discharge tube 35 is blocked. Therefore, the lower surfaces of both the protrusions 141*e* of the push member 141 are normally in pressing contact with the lower end surfaces of both the long holes 144*a* of the accommodation portion 144 by the biasing force of the compression spring 142.

In addition, the pressing load (spring constant) per unit displacement of the compression spring 142 is set to be smaller than the pressing load per unit displacement needed for the push member 141 to additionally crush the first discharge tube 35 after crushing the first discharge tube 35 until the suction passage (space) inside the first discharge tube 35 is blocked.

That is, the compression spring 142 is not compressed in the case where it receives the reaction force from the first discharge tube 35 while the push member 141 crushes the first discharge tube 35 until the suction passage inside the first discharge tube 35 is blocked, but is compressed in the case where it receives the reaction force from the first discharge tube 35 while the first push member 141 additionally crushes the first discharge tube 35 after crushing the first discharge tube 35 until the suction passage inside the first discharge tube 35 is blocked.

However, in the case where the suction passage (space) inside the first discharge tube 35 is blocked, the carriage 16 is reciprocated, and the pin portion 45 is moved toward the blocking position B in the dead end portion 72. Then, as illustrated in FIG. 20, the pin portion 45 slides across the inclined surface 143*b* of the sliding plate 143 of the first pressing unit 130 from the left to the right, and due to the sliding, the first pressing member 130 is pressed down. Correspondingly, the first discharge tube 35 is pressed by the push member 141 of the first pressing member 130, so that the cross-section thereof is changed from a substantially circular shape as illustrated in FIG. 18A to a substantially elliptical shape as illustrated in FIG. 18B.

Next, when the pin portion 45 slides across the inclined surface 143*b* from the left to the right, the first discharge tube 35 is additionally pressed by the push member 141 such that the suction passage inside the first discharge tube 35 is crushed to be almost blocked as illustrated in FIG. 18C. Then, when the pin portion 45 slides across the inclined surface 143*b* from the left to the right, due to the sliding, the first pressing member 130 is additionally pressed down.

Correspondingly, the first discharge tube 35 is additionally pressed by the push member 141, so that the suction passage inside the first discharge tube 35 is crushed to be completely blocked as illustrated in FIG. 18D. In addition, up to here, since the coil spring 142 generates the pressing load needed for the push member 141 to crush the first discharge tube 35 until the suction passage (space) inside the first discharge tube 35 is blocked, even when it receives the reaction force from the first discharge tube 35 via the push member 141, it is not compressed by the reaction force.

Next, the pin portion 45 slides across the inclined surface 143*b* from the left to the right. Until the pin portion 45 reaches the upper surface 143*a*, the first pressing unit 130 is continuously pressed down. Accordingly, the first discharge tube 35 is additionally pressed by the push member 141 after the suction passage inside the first discharge tube 35 is completely blocked.

Here, the reaction force of the first discharge tube 35 generated when the first discharge tube 35 is crushed by the first pressing unit 130 (push member 141) becomes greater after the suction passage inside the first discharge tube 35 is blocked than before the suction passage inside the first discharge tube 35 is blocked. This is because until the suction passage inside the first discharge tube 35 is blocked, the suction passage (internal space) of the first discharge tube 35 has been crushed, and after the suction passage inside the first discharge tube 35 is blocked, the first discharge tube 35 itself (the material of the first discharge tube 35) is crushed.

Therefore, in the first embodiment, after the suction passage inside the first discharge tube 35 is blocked, high reaction force is exerted on the first pressing member 47 from the first discharge tube 35, so that the loads on the pin portion 45 and the carriage 16 during the movement in the left and right direction increase. Therefore, there is a concern that durability of the components will be degraded.

In this aspect, according to this embodiment, the pressing load (spring constant) per unit displacement of the compression spring 142 is set to be smaller than the pressing load per unit displacement needed for the push member 141 to additionally crush the first discharge tube 35 after crushing the first discharge tube 35 until the suction passage (space) inside the first discharge tube 35 is blocked. Accordingly, although the first pressing unit 130 is additionally pressed down after the suction passage inside the first discharge tube 35 is blocked, when the compression spring 142 receives the reaction force of the first discharge tube 35 via the push member 141 at this time, it is compressed by the reaction force.

That is, although the first pressing unit 130 is additionally pressed down after the suction passage inside the first discharge tube 35 is blocked, the degree at which the first discharge tube 35 is additionally pressed down by the first pressing unit 130 is reduced as the compression spring 142 is compressed.

As a result, after the suction passage inside the first discharge tube 35 is blocked, the reaction force exerted on the first pressing unit 130 (push member 141) from the first discharge tube 35 is reduced, so that the loads (load on the carriage motor 18) on the pin portion 45 and the carriage 16 during the movement in the left and right direction can be suppressed, thereby enhancing the durability of the components.

In addition, when the pin portion 45 is moved to the blocking position B, the pin portion 45 is in the state (the state shown by dot-dot-dashed lines of FIG. 20) of being completely placed on the upper surface 143*a* of the sliding plate 143 of the first pressing unit 130. In this state, since the pin portion 45 presses down the first pressing unit 130 reliably, the convex strip 141*d* of the first pressing unit 130 completely crushes the first discharge tube 35 to completely block the suction passage inside the first discharge tube 35.

According to the fifth embodiment described above, in addition to the effects of (1) to (4), the following effects can be obtained.

(9) The pressing load (spring constant) per unit displacement of the compression spring 142 is set to be smaller than the pressing load per unit displacement needed for the push member 141 to additionally crush the first discharge tube 35 after crushing the first discharge tube 35 until the suction passage (space) inside the first discharge tube 35 is blocked. Accordingly, although the first pressing unit 130 is additionally pressed down after the suction passage inside the first discharge tube 35 is blocked, the degree at which the first discharge tube 35 is additionally pressed down by the first pressing unit 130 can be absorbed and reduced as the compression spring 142 is compressed. As a result, after the suction passage inside the first discharge tube 35 is blocked, the reaction force exerted on the first pressing unit 130 (push member 141) from the first discharge tube 35 is reduced, so that the loads (load on the carriage motor 18) on the pin portion 45 and the carriage 16 during the movement in the left and right direction can be suppressed, thereby enhancing the durability of the components.

Modified Examples

In addition the embodiments may be modified as follows.

An elevating device for elevating the cap 27 along with the cap holder 26 may be provided. In this case, the engagement bar 28 on the cap holder 26 is omitted, and the through-grooves 25 of both the supporting plates 24 extend in the up and down direction.

During the reciprocating movement of the carriage 16 in the left and right direction from the home position as a starting point in the maintenance area MA, the cap 27 is not necessarily maintained to come in contact with the print head 19. That is, only while the pin portion 45 of the swing member 42 is at least one of the non-blocking position A, the blocking position B, and the blocking position C, may the cap 27 come in contact with the print head 19.

The valve units 40 and 90 may be laid down horizontally. In this case, so as not to allow the swing member 42 to be tilted by gravity to lower the pin portion 45, a biasing unit for biasing the swing member 42 upwardly to maintain the horizontal position is necessary.

At least one of the first and second pressing members 47 and 48 may be omitted. In this case, at least one of both the discharge tubes 35 and 37 corresponding to the at least one of the first and second pressing members 47 and 48 which is omitted, is disposed to cross the horizontal surface in the valve units 40 and 90 and directly crushed and blocked by the pin portion 45 of the swing member 42.

The swing member 42 may be configured not to be swung but to be moved linearly along the front and rear direction that is perpendicular to the left and right direction that is the movement direction of the carriage 16, and the up and down direction that is a direction in which the cap 27 comes in contact with the print head 19.

The cap 27 may be configured such that the inside thereof is isolated into four chambers in the left and right direction, and the cap 27 comes in contact with the print head 19 so as to allow the chambers to individually cover the nozzle rows 22A to 22D. In this case, the valve units 40 and 90 need five dead end portions of the groove 70 of the cover member 49 and 92 such that the four discharge tubes extending from the chambers of the cap 27 are selectively crushed by the pin portion 45 of the swing member 42 via the four pressing members.

Similarly, the number of nozzle rows may be five or more, and the maintenance mechanism 23 may be configured to allow the cap 27 of which the inside is isolated into an arbitrary number of chambers to cover an arbitrary number of nozzle rows. In this case, the numbers of nozzle rows covered by the chambers of the cap 27 may be the same or may be different from each other.

The valve unit 112 of the third embodiment may be the same mechanism as the valve unit 90 of the second embodiment. That is, the valve unit 112 of the third embodiment is, similarly to the valve unit 90 of the second embodiment, provided with the slider 93 for covering the upper surface side of the cover member 49, and the swing member 42 is swingably supported by the slider 93.

In the fourth embodiment, at least one of the inclined surfaces 61*ba*, 61*bb*, 64*ba*, and 64*bb* may be a curved surface.

In the fourth embodiment, the sliding surface of the first and second pressing member 47 or 48 may be configured by three or more continuous inclined surfaces having different tilt angles from each other with respect to the horizontal plane.

In the fifth embodiment, the inclined surface 143*b* may be configured by plural continuous inclined surfaces having different tilt angles from each other with respect to the horizontal plane as in the fourth embodiment.

In the embodiments, the ink jet type printer 11 is employed. However, a fluid ejecting apparatus for ejecting or discharging fluids other than the ink may be employed. In addition, various types of liquid ejecting apparatus having a liquid ejecting head for discharging a small amount of liquid droplets or the like may be employed. In this case, liquid droplets refer to a liquid state discharged from the liquid ejecting apparatus, and may include grain-shaped and tear-shaped droplets and droplets leaving string-shaped traces. The liquid described herein may be any material that the liquid ejecting apparatus can eject. For example, materials in a liquid state may be employed, and the materials include a flow state material such as a liquid state material having high or low viscosity, a colloidal solution, gel water, inorganic solvents, organic solvents, solutions, liquid resin, and liquid metal (metal melt), liquid in a primary material state, and those in which particles of functional material made of solids such as pigments and metal particles are dissolved in, distributed through, or mixed with a solvent. In addition, a representative example of the liquid may be the ink described above in the embodiment or liquid crystals. Here, the inks may include various types of liquid composition such as general water-based ink and oil-based ink, gel ink, and hot melt ink. Examples of the liquid ejecting apparatus may include liquid crystal displays, EL (electroluminescence) displays, surface-emitting displays, liquid ejecting apparatuses for ejecting liquid in which an electrode material or a color material used for manufacturing a color filter or the like is distributed or dissolved, liquid ejecting apparatuses for ejecting bio-organic materials used for manufacturing a bio chip, liquid ejecting apparatuses for ejecting liquid used for a precision pipette as a sample, printing apparatuses, microdispensers, and the like. Additionally, liquid ejecting apparatuses for ejecting lubricating oil at a pinpoint into a precision machine such as a watch or a camera, liquid ejecting apparatuses for ejecting transparent resin liquid such as UV cured resin on a substrate to form a micro hemispherical lens (optical lens) used for an optical communication element and the like, and liquid ejecting apparatuses for ejecting an acid or alkali etchant for performing etching on a substrate or the like, may be employed. In addition, the invention can be applied to any type of these liquid ejecting apparatus.

Additionally, the technical spirit and scope that can be attained will be described rather than the embodiments.

(A) A fluid ejecting apparatus including: a carriage that supports a fluid ejecting head for ejecting fluid through a plurality of nozzles and is able to be reciprocated; a cap unit that comes in contact with the fluid ejecting head to form a plurality of cap internal spaces individually enclosing the nozzles; and a suction unit that is able to suck the cap internal spaces via respective suction passages.

The fluid ejecting apparatus including a selective blocking unit that is able to selectively block the suction passages as the carriage is reciprocated in a maintenance area for the maintenance of the fluid ejecting head.

In this configuration, the suction passages can be selectively blocked by the selective blocking unit as the carriage is reciprocated in the maintenance area. Therefore, it is possible to selectively block the suction passages without expanding the movement range of the carriage. Accordingly, it is possible to selectively suck the plurality of cap internal spaces without an increase in size.

What is claimed is:

1. A fluid ejecting apparatus comprising:

a carriage that supports a fluid ejecting head for ejecting fluid through a plurality of nozzles and is able to be reciprocated;

a cap unit that comes in contact with the fluid ejecting head to form a plurality of cap internal spaces individually enclosing the nozzles;

a suction unit that is able to suck the cap internal spaces via respective suction passages; and a selective blocking unit that is able to selectively block the suction passages as the carriage is reciprocated in a maintenance area for the maintenance of the fluid ejecting head, wherein the selective blocking unit includes:

a blocking member rotatably coupled to the carriage, wherein the blocking member is reciprocated as the carriage is reciprocated in the maintenance area; and cam surfaces that engage with the blocking member as the blocking member is reciprocated to lead the blocking member to blocking positions for blocking the suction passages in order.

2. The fluid ejecting apparatus according to claim 1, wherein each suction passage is formed of a tube having flexibility, and when the blocking member is at the blocking position, the blocking member crushes the tube corresponding to the blocking member.

3. The fluid ejecting apparatus according to claim 2, wherein a pressing member that is able to press the tube is disposed at each blocking position, and the blocking member crushes the tube via the pressing member when the blocking member is moved to the blocking position.

4. The fluid ejecting apparatus according to claim 3, wherein the pressing member includes:

a first member having a sliding surface on which the blocking member slides as the carriage is reciprocated to allow the pressing member to move in a direction to press the tube;

a second member that is disposed between the first member and the tube so as to come in contact with and press the tube; and a compression spring that is maintained between the first member and the second member in a state where it generates a pressing load needed to crush the tube and block the suction passage, and of which a load per unit displacement is set to be smaller than a load per unit displacement needed for the second member to additionally crush the tube after pressing the tube and blocking the suction passage.

5. The fluid ejecting apparatus according to claim 4, wherein the sliding surface is configured by a plurality of surfaces that are set to allow a degree of movement of the pressing member to differ in a direction to press the tube as the blocking member slides, and the surfaces are arranged such that the degree of movement of the pressing is decreased in the direction to press the tube as the degree of pressing at which the tube is pressed by the pressing member is increased.

6. The fluid ejecting apparatus according to claim 1, wherein the cap unit includes a cap member that engages with the carriage as the carriage is moved in the maintenance area to move along the movement direction of the carriage so as to be moved in a direction to approach the fluid ejecting head and then come in contact with the fluid ejecting head, and while the carriage is reciprocated in the maintenance area, the contacting state of the cap member with the fluid ejecting head is maintained.

7. The fluid ejecting apparatus according to claim 1, wherein the blocking member is swingably fitted to a portion of the carriage.

* * * * *